US011333136B2

(12) United States Patent
Ono et al.

(10) Patent No.: US 11,333,136 B2
(45) Date of Patent: May 17, 2022

(54) FLUID PUMP WITH CAM GEOMETRY TO REDUCE PULSATIONS

(71) Applicant: AISIN CORPORATION, Kariya (JP)

(72) Inventors: Hisashi Ono, Okazaki (JP); Katsuhiko Takasu, Nishio (JP); Koji Nunami, Obu (JP)

(73) Assignee: AISIN CORPORATION, Aichi (JP)

( * ) Notice: Subject to any disclaimer, the term of this patent is extended or adjusted under 35 U.S.C. 154(b) by 226 days.

(21) Appl. No.: 16/197,508

(22) Filed: Nov. 21, 2018

(65) Prior Publication Data

US 2019/0154016 A1 May 23, 2019

(30) Foreign Application Priority Data

Nov. 22, 2017 (JP) ..... JP2017-224864
Jan. 22, 2018 (JP) ..... JP2018-008354
Jul. 27, 2018 (JP) ..... JP2018-141695

(51) Int. Cl.
*F04B 9/04* (2006.01)
*F04B 1/0413* (2020.01)
(Continued)

(52) U.S. Cl.
CPC ..... *F04B 9/042* (2013.01); *F04B 1/0413* (2013.01); *F04B 1/0421* (2013.01);
(Continued)

(58) Field of Classification Search
None
See application file for complete search history.

(56) References Cited

U.S. PATENT DOCUMENTS 4,233,156 A * 11/1980 Tsukada ..... B01D 15/08 210/101
4,359,312 A * 11/1982 Funke ..... F04B 11/0058 417/18
(Continued)

FOREIGN PATENT DOCUMENTS

JP 59162380 A 9/1984
JP H01294981 A 11/1989
(Continued)

OTHER PUBLICATIONS

Notice of Reasons for Refusal issued in corresponding JP application 2018-141695, dated Mar. 22, 2022. 8 Pages with English Translation.

*Primary Examiner* — Peter J Bertheaud
*Assistant Examiner* — Geoffrey S Lee
(74) *Attorney, Agent, or Firm* — Buchanan Ingersoll & Rooney PC

(57) ABSTRACT

A fluid pump includes: three or more volume chambers that suction and discharge a fluid sequentially; moving elements that are respectively provided in the volume chambers, move relative to the volume chamber, and suction and discharge the fluid from and to the volume chamber; a cam that abuts against and drives the moving elements; and a driving section that drives at least one of the moving elements and the cam and relatively rotates the moving elements and the cam to discharge the fluid one time from each of the volume chambers in one cycle of the relative rotation, in which, when suctioning and discharging the fluid, regarding a discharge rotation angle α, $\alpha=(Z/M)\times N$ is satisfied, where the number of volume chambers is M and any integer from 2 to (M−1) is N.

11 Claims, 12 Drawing Sheets

(51) Int. Cl.

| | |
|---|---|
| ***F04B 1/0426*** | (2020.01) |
| ***F04B 1/0421*** | (2020.01) |
| ***F04B 11/00*** | (2006.01) |
| ***F04B 1/053*** | (2020.01) |
| ***F04B 1/20*** | (2020.01) |
| *F04B 17/05* | (2006.01) |

(52) U.S. Cl.
CPC ..... *F04B 1/0426* (2013.01); *F04B 1/053* (2013.01); *F04B 1/20* (2013.01); *F04B 11/005* (2013.01); *F04B 17/05* (2013.01)

(56) References Cited

U.S. PATENT DOCUMENTS

| | | | | |
|---|---|---|---|---|
| 4,492,524 | A * | 1/1985 | Koch | F04B 49/20 417/18 |
| 4,738,603 | A | 4/1988 | Hattori | |
| 7,004,121 | B2 * | 2/2006 | Moe | F04B 1/146 123/56.2 |

FOREIGN PATENT DOCUMENTS

| | | | |
|---|---|---|---|
| JP | H04269387 | A | 9/1992 |
| JP | H06-43275 | U | 6/1994 |
| JP | 2002048055 | A | 2/2002 |
| JP | 2006046150 | A | 2/2006 |

* cited by examiner

FLUID PUMP WITH CAM GEOMETRY TO REDUCE PULSATIONS

CROSS REFERENCE TO RELATED APPLICATIONS

This application is based on and claims priority under 35 U.S.C. § 119 to Japanese Patent Applications 2017-224864, 2018-8354 and 2018-141695 filed on Nov. 22, 2017, Jan. 22, 2018 and Jul. 27, 2018 respectively, the entire contents of which are incorporated herein by reference.

TECHNICAL FIELD

This disclosure relates to a fluid pump which is mounted in a vehicle or the like and substantially reduces pulsation of a discharge pressure when supplying various fluids, such as hydraulic oil.

BACKGROUND DISCUSSION

In the related art, as a fluid pump for reducing pulsation of a discharge pressure, there is a fluid pump described in the following JP 2002-48055A (Reference 1).

The fluid pump described in Reference 1 supplies hydraulic oil to two hydraulic motors that rotate a propeller for propelling a ship. Here, two swash plate type piston pumps are coaxially attached to a rotary shaft of a diesel engine, and the hydraulic oil is discharged in phases opposite to each other.

The hydraulic oil discharged in the opposite phases is sent to each hydraulic motor via a separate pressure piping, but in the middle of the pressure piping, a pipeline that connects the pipings to each other is provided. A free piston is inserted into the pipeline, and the pulsation pressure generated by the two hydraulic pumps is propagated from one side to the other side. Accordingly, both pulsation waves cancel out each other, a hydraulic pulsation is substantially removed, and vibration or noise during the operation of the diesel engine are reduced.

In addition, as another pump for reducing the pulsation of the discharge pressure, there is a vane pump described in the following JP 59-162380A (Reference 2).

The vane pump includes a housing, a cam ring, a rotor having a plurality of vanes, a suction port and a discharge port for supplying and discharging a fluid from and to a vane chamber formed between the rotor, the vane, and the cam ring are provided, and in particular, a maximum gradient angle of an inner peripheral surface of the cam ring is set to 0.9 to 1.7 with respect to a gradient angle in an expansion section of a reference cam curve in a section in which the vane chamber expands.

Here, the "maximum gradient angle" of the cam ring is a gradient of the curve when the shape of the cam surface of the cam ring is expressed in a graph. For example, the curve in which the horizontal axis represents a rotation angle of the rotor and the vertical axis represents a change in a protrusion amount of the vane is substantially trapezoidal. In other words, when the rotor is rotated, a state where the vane has entered the rotor most is set to a state where the protrusion amount of the vane is zero, and a projection amount of the vane becomes a maximum value at a position where the rotor is rotated by 180 degrees. When connecting the two regions to each other in the middle thereof, a graph having a substantially trapezoidal shape as a whole is achieved. The "maximum gradient angle" refers to an angle at which the gradient of the graph obtained in this manner becomes the maximum value. In other words, as the maximum gradient angle increases, the protrusion amount of the vane increases with respect to a unit rotation angle of the rotor.

Meanwhile, the "reference cam curve" also divides the process in which the rotor makes one rotation into four sections. However, the graph here is completely trapezoidal. In other words, a section that corresponds to one pitch of the vane is defined as a region where the protrusion amount of the vane is zero, a region where the protrusion amount of the vane becomes the maximum value for a section that corresponds to one pitch of the vane is provided at a position separated by 180 degrees therefrom, and the remaining is made by connecting the regions to each other by a straight line. Accordingly, the gradient angle in the expansion section of the "reference cam curve" is simply a constant because the graph of the section is a straight line.

In the technology according to Reference 2, the maximum gradient angle of the cam ring is set to 0.9 to 1.7 with respect to the gradient angle of the reference cam curve. The reason why a lower limit value is set is that, when the lower limit value becomes extremely small, the expansion section in which the vane projects becomes longer, the other region becomes narrow, and the pulsation is prevented from increasing in the fluid. Meanwhile, the reason why an upper limit value is set is that, when the upper limit value becomes extremely large, a maximum projection speed of the vane in the expansion section becomes larger, the expansion speed of the vane chamber becomes excessive, a fluid inflow is not smoothly performed, and the pulsation is prevented from increasing.

However, in this configuration, a case where the maximum gradient angle of the cam ring is set to 1.0 which is the same as the gradient angle of the reference cam curve is also included, and thus, there is no difference from the technology in the related art. However, Reference 2 discloses a technology in which a connecting part between each section of the reference cam curve is rounded, projection of the vane and acceleration are prevented from becoming excessive, and the pulsation is reduced while the projection speed of the vane is constant in a central portion of the expansion section. Although there is no description in Reference 2 regarding a specific configuration for "making the connecting part round", it can be inferred that some shaping is performed with respect to the cam surface.

With such a configuration, the technology of Reference 2 reduces the pulsation of an instantaneous discharge flow rate, reduces the flow rate pulsation and the pressure pulsation in a discharge pipeline, and reduces noise and vibration generated in the fluid system mainly by the fluid pressure pump.

The fluid pump of Reference 1 simply sets a driving phase of the two fluid pumps reversely. In this case, the overall vibration or noise generated by the two fluid pumps is reduced to some extent. However, the pulsation generated by each fluid pump is not eliminated.

In the technology of Reference 1, the swash plate type piston pump is used as a fluid pump. One swash plate type piston pump is provided with a plurality of pistons, the hydraulic oil sequentially discharged from the pistons is collected in one pipeline and supplied to the hydraulic motor. However, the technology of Reference 1 does not show any improvement proposal for each fluid pump.

In a case where the fluid pump is mounted on a vehicle or the like, it is not always possible to combine a plurality of fluid pumps as in the technology of the above-described Reference 1 due to the required discharge amount of the hydraulic oil or a mounting space. Rather, it is expected that there are many cases where it is forced to install a single fluid pump. Therefore, there is a limit in reducing the pulsation of the hydraulic pressure generated from the fluid pump.

Meanwhile, it is possible to understand that the fluid pump of Reference 2 is a technology which relates to a graph illustrating the protrusion amount of the vane, regulates the projection speed of the vane smoothly connecting the curves of a boundary between the expansion section and both sections with the expansion section interposed therebetween, and reduces a sudden change in the supply amount of the fluid in the expansion section.

However, the technology disclosed here is only the point to be noted with respect to the projection speed for one vane. For example, the graphs illustrated at the lower part of FIG. 2, the upper part of FIGS. 5 and 6, and the like in the specification are only the graphs illustrating an instantaneous discharge amount of a part where a protrusion speed of the vane becomes the maximum value. Accordingly, it is not described how to eliminate the pulsation with respect to the total amount of the fluid discharged from each vane chamber in a case where a plurality of vane chambers communicate with the discharge port of the vane pump.

Thus, a need exists for a fluid pump which is not susceptible to the drawback mentioned above.

SUMMARY

A feature of a fluid pump according to an aspect of this disclosure resides in that the fluid pump includes three or more volume chambers that suction and discharge a fluid sequentially; moving elements that are respectively provided in the volume chambers, move relative to the volume chamber, and suction and discharge the fluid from and to the volume chamber; a cam that abuts against and drives the moving element; and a driving section that drives at least one of the moving elements and the cam and relatively rotates the moving elements and the cam to discharge the fluid one time from each of the volume chambers in one cycle of the relative rotation, in which, in each of the volume chambers, when suctioning and discharging the fluid, regarding a discharge rotation angle $\alpha$ from a start phase in which an instantaneous discharge amount of the fluid is zero is achieved, then a central phase in which the instantaneous discharge amount becomes a maximum value is achieved and an end phase in which the instantaneous discharge amount is again zero is achieved among one-cycle rotation angles Z according to the one cycle, $\alpha=(Z/M)\times N$ is satisfied, where the number of volume chambers is M and any integer from 2 to (M−1) is N, in which, when any one of the volume chambers has reached the end phase, an N-th volume chamber subsequent to the volume chamber is configured to be in the start phase, in which, when a phase which is exactly in a middle between the start phase and the central phase is set as a first intermediate phase, an increasing tendency of the instantaneous discharge amount from the start phase to the first intermediate phase and an increasing tendency from the first intermediate phase to the central phase are inverted to each other with the central phase interposed therebetween, and in which an increasing tendency from the start phase to the central phase and a decreasing tendency of the fluid from the central phase to the end phase are symmetric to each other with the first intermediate phase interposed therebetween.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Overall Outline

A fluid pump S according to the disclosure is intended to prevent pulsation of the fluid W caused by fluctuations or the like in a discharge pressure or vibration or the like of the fluid pump S or a connecting piping when discharging a fluid W. As the configuration of the fluid pump S, three or more volume chambers B for sequentially suctioning and discharging the fluid W, and moving elements D which are provided for each of the volume chambers B, move relative to the volume chamber B, and suction and discharge the fluid W from and to the volume chamber B are provided.

The moving element D and the cam C that abuts against the moving element D relatively rotate, and at least any one of the moving element D and the cam C is driven by a driving section G. By rotating the moving element D and the cam C relative to each other in one cycle, the fluid W is discharged from each of the volume chambers B one time.

In order to suppress the pulsation in the fluid pump S including the plurality of the volume chambers B in this manner, it is necessary to successfully harmonize the characteristics of a fluid discharge in the specific volume chamber B and the characteristics of a fluid discharge in the other volume chamber B. Therefore, in the fluid pump S of the disclosure, a configuration in which a change mode of the instantaneous discharge amount of the fluid W in each of the volume chambers B is strictly regulated, and the increase and decrease in the instantaneous discharge amount in each of the volume chambers B successfully complement each other, is employed.

Hereinafter, as the fluid pump S according to the disclosure, while an embodiment using a plunger P having a piston 1 and a cylinder 2 and an embodiment using a rotor r having a vane V are illustrated, a feature configuration of the fluid pump S will be described.

First Embodiment

Figure 1:
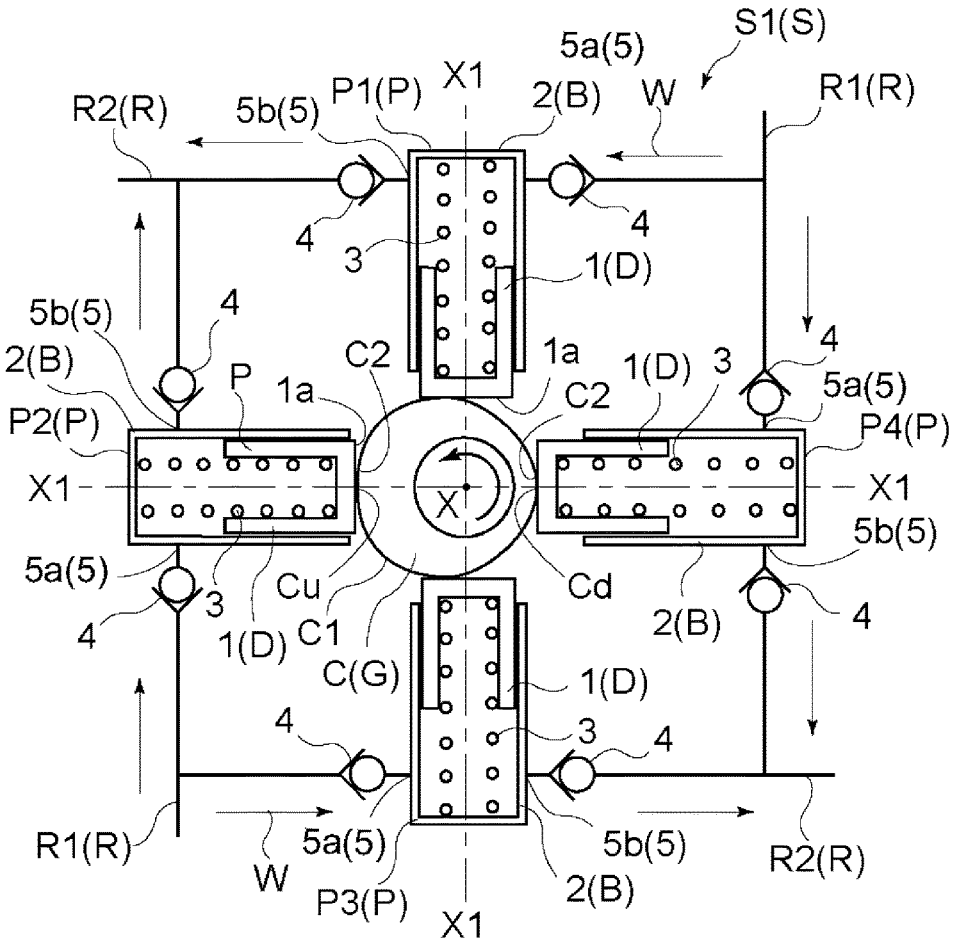
FIG. 1 is an explanatory view illustrating a configuration of a radial pump according to a first embodiment.
Figure 2:
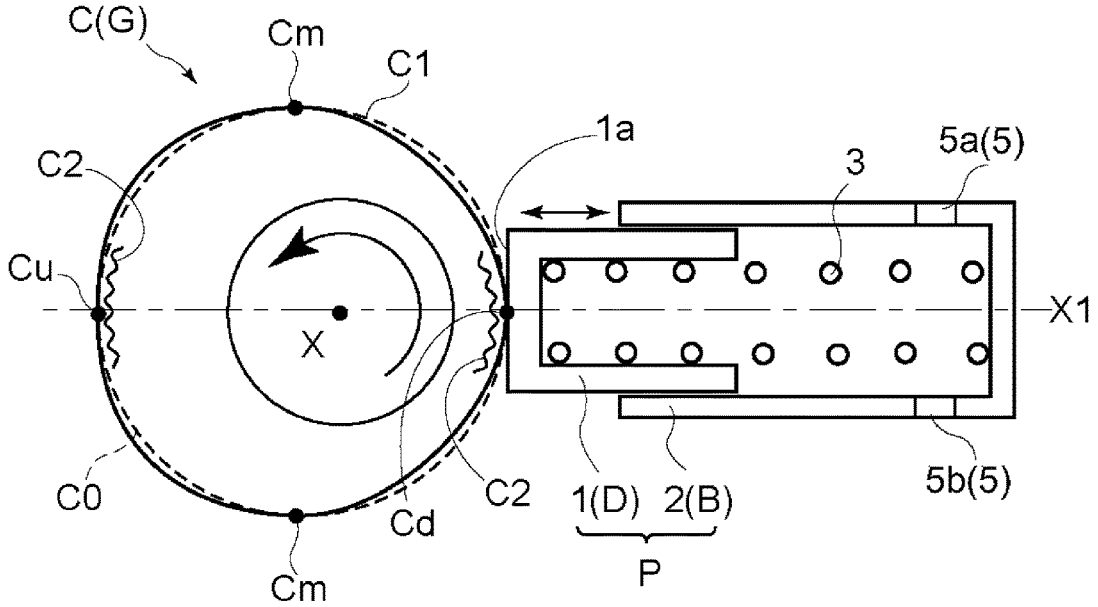
FIG. 2 is an explanatory view illustrating a detailed shape of a cam according to the first embodiment.

A first embodiment of the fluid pump S according to the disclosure will be described with reference to FIGS. 1 to 10. The fluid pump S is a so-called radial pump S1 including the plurality of plungers P having the cylinder 2 which is the volume chamber B and the piston 1 which is the moving element D. As illustrated in FIGS. 1 and 2, for example, one cam C capable of operating the piston 1 of the plunger P only by one cycle with one rotation is disposed at a center position. For example, a first plunger P1 to a fourth plunger P4 are disposed around a rotating axis X of the cam C so as to have a rotation angle of 90 degrees. By the cam C, each of the plungers P is sequentially driven, and the piston 1 reciprocates. Accordingly, the fluid W, such as hydraulic oil, is supplied to and discharged from the cylinder 2, and the fluid W is transported to a predetermined location.

The radial pump S1 using the plunger P has been widely used from the related art. At least one flow passage R is connected to the cylinder 2. In a case where there is one flow passage R, the tip of the flow passage R branches in two directions, and for example, a check valve 4 is provided. Accordingly, in a case where the piston 1 is pushed out by a spring member 3, only one check valve 4 is opened, and the fluid W flows into the cylinder 2 from a suction port 5*a*. Subsequently, in a case where the piston 1 is pushed in by the cam C, only the other check valve 4 is opened, and the fluid W is discharged from a discharge port 5*b*. In this manner, the radial pump S1 having a simple structure is formed.

However, in the radial pump S1 using only one plunger P, since the supply and discharge of the fluid W are alternately performed, a flow pulsation is generated when the fluid W flows. Here, in the embodiment, the pulsation is eliminated by combining the plurality of plungers P and devising the shape of the cam C.

Cylinder

As illustrated in FIG. 1, in the embodiment, four plungers P, such as the first to fourth plungers P1 to P4, are provided. Each of the plungers P1 to P4 has the cylinder 2 and the piston 1. The plungers P are disposed every 90 degrees around the rotating axis X of the cam C, and a phase difference is provided by a quarter cycle with respect to the cycle of one rotation of the cam C. In each cylinder 2, for example, the suction port 5*a* and the discharge port 5*b* of the fluid W are separately formed. Accordingly, it is possible to smoothly suction and discharge the fluid W.

Piston

The pistons 1 that reciprocate along the inner surface are inserted into each cylinder 2. The spring member 3 is provided over a part of the piston 1 and a part of the cylinder 2, the piston 1 is always biased toward the cam C side, and thus, an abutting state of an outer end surface 1*a* of the piston 1 and the cam C is maintained.

Flow Passage

A supply passage R1 that serves as the flow passage R for supplying the fluid W to the inside of the cylinder 2 is connected to the suction port 5*a* of each cylinder 2. A discharge passage R2 that serves as the flow passage R for transporting the fluid W to another fluid supply destination is connected to one discharge port 5*b*. The four supply passages R1 connected to each of the cylinders 2 may be branched from, for example, one large-diameter piping. In addition, the four discharge passages R2 may be integrally combined and used as a large-diameter piping.

As illustrated in FIG. 1, for example, the check valve 4 is provided in each of the supply passage R1 and the discharge passage R2. Accordingly, a flow direction of the fluid W is restricted in one direction from the supply passage R1 to the discharge passage R2. Furthermore, any configuration may be employed as long as the check valve 4 has a function of a one-way valve.

Cam

As illustrated in FIG. 1, the cam C of the embodiment has a cross section close to a circular shape and rotates around the eccentric rotating axis X. Although not illustrated, rotational driving from the driving section G is transmitted to the cam C. The piston 1 abuts against the cam C from a direction perpendicular to the rotating axis X. With the configuration, it is easy to dispose each plunger P, and it is possible to obtain the radial pump S1 with a stable discharge flow rate only by mainly configuring the cam surface C1 of the cam C to have a predetermined shape.

Before describing the cam C of the configuration, an example of a case where the cross section of the cam C is a perfect circle as indicated by the dotted line in FIG. 2 will be described. The characteristics of the radial pump S1 using the cam C are illustrated in FIGS. 3 to 6.

Figure 3:
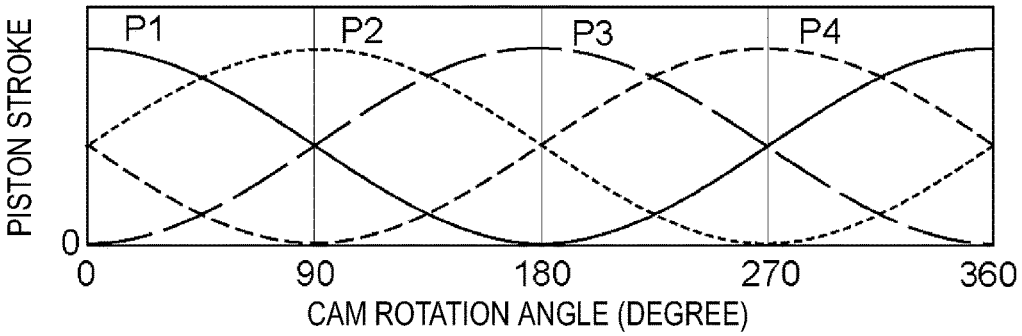
FIG. 3 is a graph illustrating a stroke change of a piston according to an example of the related art.

In FIG. 3, the horizontal axis represents the rotation angle of the cam C, and the vertical axis represents the stroke of the piston 1. The piston stroke is set to zero when the piston 1 is at the bottom dead point and the stroke is set to become larger as moving toward the top dead point. When the cam C makes one rotation and the piston 1 reciprocates one time, the stroke of the piston 1 associated with each of the plungers P1 to P4 is sequentially delayed by a quarter cycle. A movement curve of the piston 1 is a sine curve.

Figure 4:
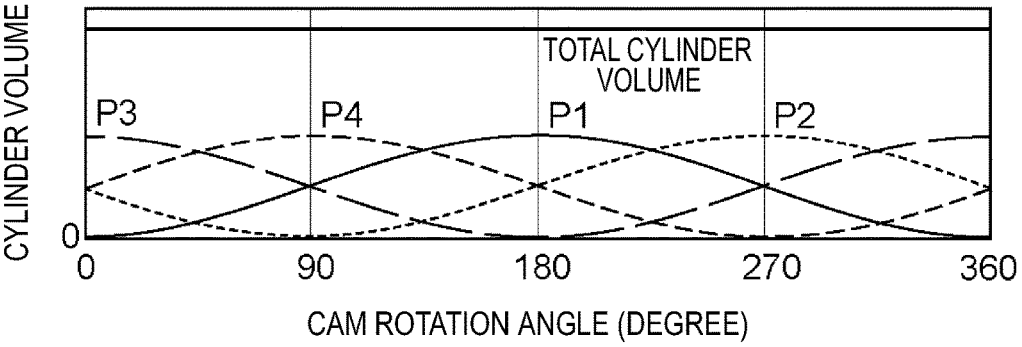
FIG. 4 is a graph illustrating a volume change of a cylinder according to the example of the related art.

FIG. 4 is a curve illustrating a volume change of the cylinder 2. A cylinder volume is a volume change amount when the piston 1 reciprocates. A case where the cylinder volume is zero means a case where the piston 1 is at the top dead point. From this position, the cylinder volume increases as the piston 1 moves toward the bottom dead point. The value of the vertical axis can be calculated, for example, by multiplying the cross-sectional area of the cylinder 2 by the stroke distance of the piston 1. This curve also becomes a sine curve.

Figure 5:
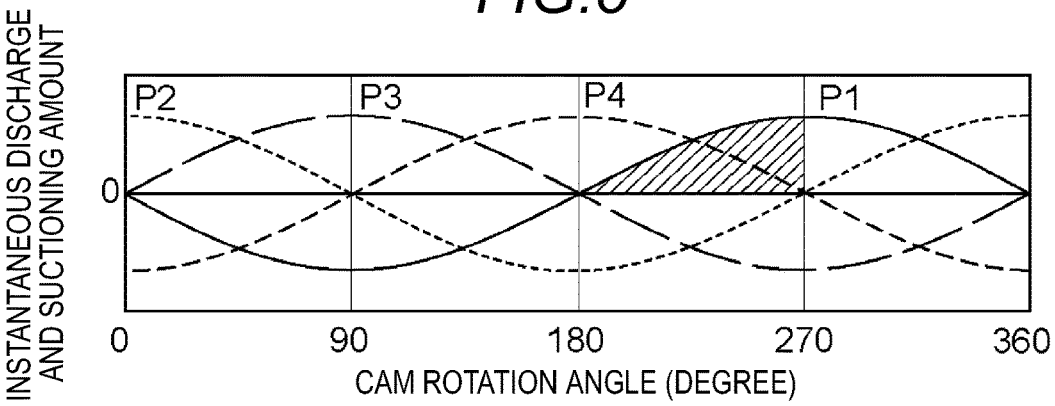
FIG. 5 is a graph illustrating a change in an instantaneous discharge amount of each plunger according to the example of the related art.

FIG. 5 illustrates an instantaneous flow rate of the fluid W that is suctioned into or discharged from the plunger P. In other words, a curve in FIG. 5 is similar to the curve obtained by differentiating the curve in FIG. 4 with the rotation angle of the cam C.

Figure 6:
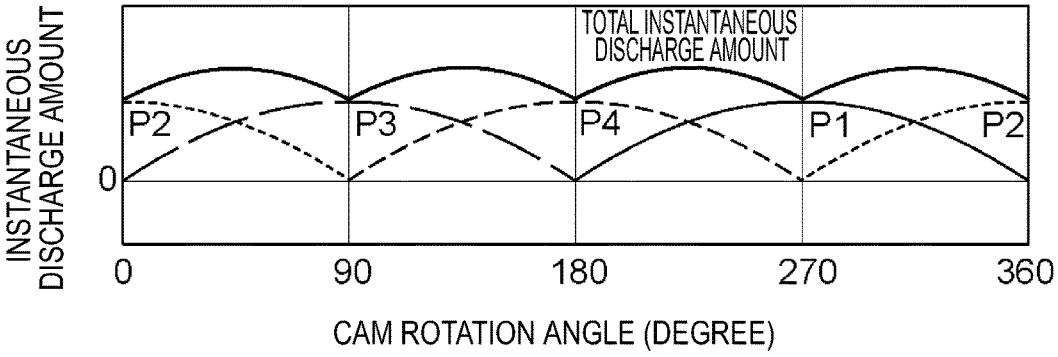
FIG. 6 is a graph illustrating a change in a total instantaneous discharge amount of a fluid according to the example of the related art.
Figure 7:
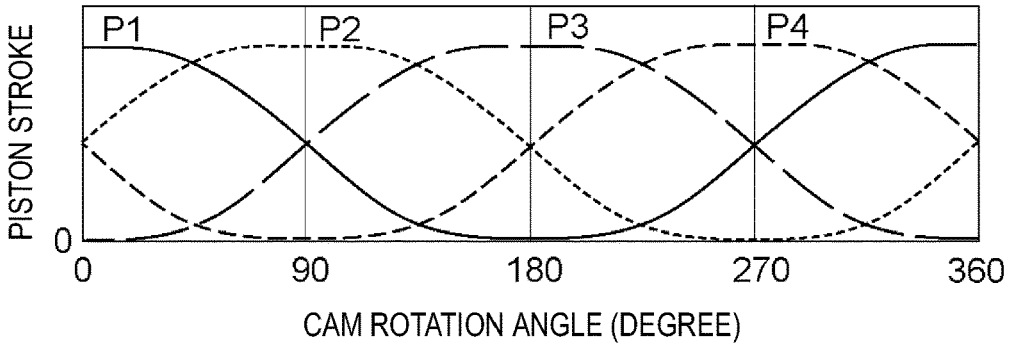
FIG. 7 is a graph illustrating the stroke change of the piston according to the first embodiment.
Figure 8:
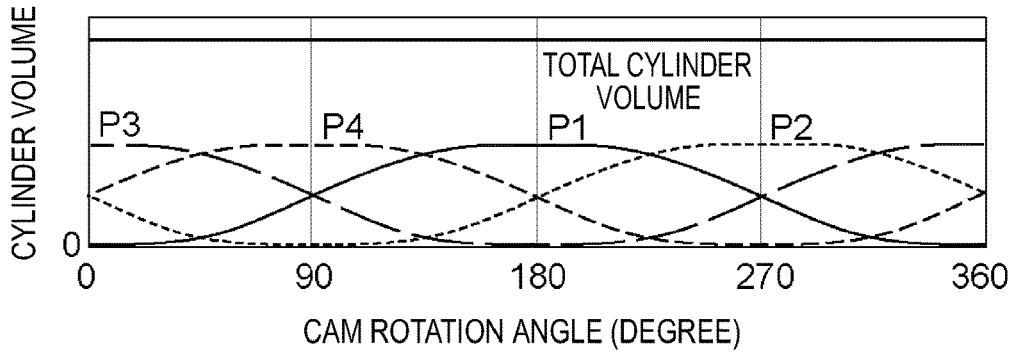
FIG. 8 is a graph illustrating the volume change of the cylinder according to the first embodiment.

In FIG. 6, in the curve illustrated in FIG. 5, a part at which the fluid W is suctioned into the four cylinders 2 is omitted, and only the instantaneous discharge amount at which the fluid W is discharged is described. Furthermore, the bold line that changes to a waveform in the drawing indicates the total instantaneous discharge amount obtained by adding the four curves. The up-down change of the total instantaneous discharge amount expresses the presence of the pulsation.

In a case where the cross-sectional shape of the cam C is a perfect circle, as illustrated in FIG. 6, the curve indicating the total instantaneous discharge amount has a shape obtained by simply connecting substantially arc-shaped curves. In this case, the curve is bent at an acute angle particularly at the moment when the discharge amount decreases and turns to an increase again. Here, the total instantaneous discharge amount suddenly changes and the constant pulsation is generated.

In order to reduce the pulsation, for example, the number of plungers P may be increased. By doing so, the increase and decrease width of the fluid W discharged by each of the plungers P is mitigated, and the cycle of the pulsation is shortened. However, only by simply increasing the number of plungers P, it is not possible to completely eliminate the pulsation. Here, in the embodiment, the sectional shape of the cam C which is a perfect circle is corrected as described below.

Figure 10:
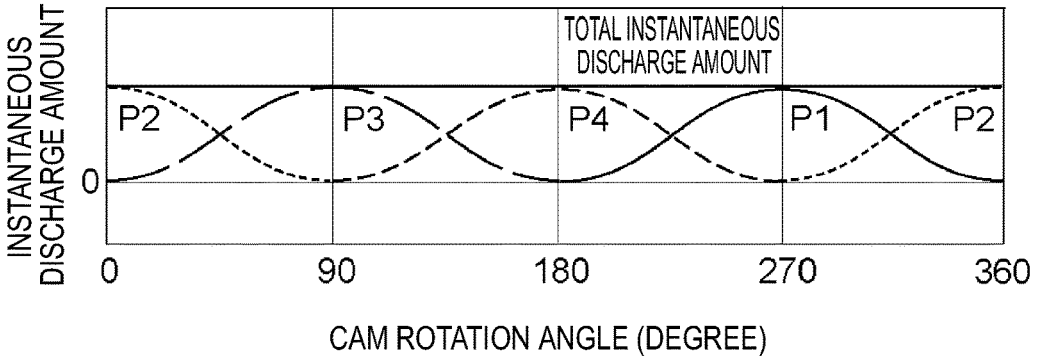
FIG. 10 is a graph illustrating a change in a total instantaneous discharge amount of a fluid according to the first embodiment.

FIG. 10 illustrates the instantaneous discharge amount and the total instantaneous discharge amount of each of the plungers P in a case of using the cam C of the embodiment illustrated in FIG. 1. In order to make the total instantaneous discharge amount constant as in the example, it is necessary to appropriately set the curve of the instantaneous discharge amount of each of the plungers P. Specifically, when the instantaneous discharge amount reaches zero and when the instantaneous discharge amount reaches the maximum value, the degree of change in the instantaneous flow rate is reduced. As illustrated in FIG. 10, for example, when expressing the instantaneous discharge amount of each of the plungers P, each curve has a shape that is in contact with the horizontal axis on which the instantaneous discharge amount is zero and the horizontal axis indicating the total instantaneous discharge amount.

In order to obtain such a curve of the instantaneous discharge amount, for example, as emphasized by the broken line in FIG. 2, in a region including a top dead corresponding point Cu for positioning the piston 1 at the top dead point on the cam surface C1, and in a region including a bottom dead corresponding point Cd for positioning the piston 1 at the bottom dead point, a discharge amount adjustment surface C2 for reducing the position change of the piston 1 with respect to the unit movement of the cam C is formed. More specifically, a perfect circular cam C0 (indicated by the dotted line) including the top dead corresponding point Cu and the bottom dead corresponding point Cd in a radial direction has a basic configuration, and both sides of the top dead corresponding point Cu have a bulge on the outer side in the radial direction with respect to the perfect circular cam C0. It is assumed that the bulge does not reach an intermediate position Cm exactly in the middle between the top dead corresponding point Cu and the bottom dead corresponding point Cd on the outer peripheral surface of the cam C. Meanwhile, both sides of the bottom dead corresponding point Cd are recessed to the inner side in the radial direction with respect to the perfect circular cam C0. The recess also does not reach the intermediate position Cm on the outer peripheral surface of the cam C.

Figure 9:
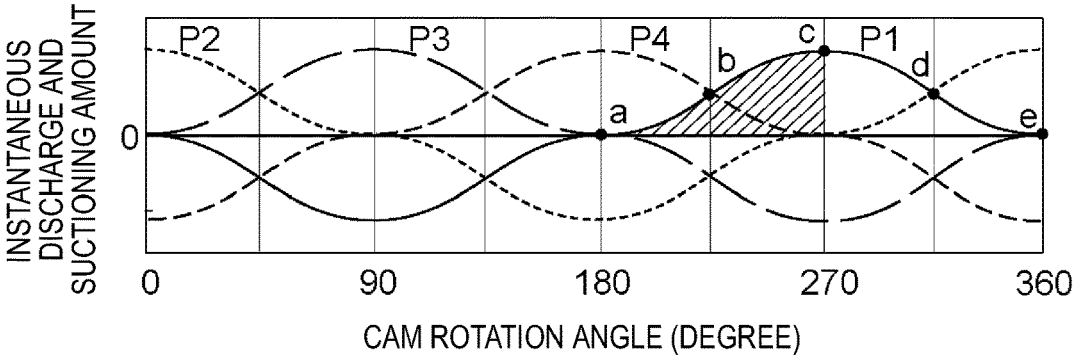
FIG. 9 is a graph illustrating a change in the instantaneous discharge amount of each plunger according to the first embodiment.

By configuring the shape of the cam C in this manner, the volume change amount (instantaneous discharge amount of the plunger P) of the piston 1 with respect to the unit movement amount of the cam C at an individual action position from the bottom dead corresponding point Cd of the cam surface C1 to the top dead corresponding point Cu becomes the maximum value at the position between the bottom dead corresponding point Cd and the top dead corresponding point Cu. For example, the intermediate position Cm is the position thereof. When the intermediate position Cm of the cam C is an instantaneous discharge amount maximum position, as illustrated in FIG. 9, for example, with respect to the solid line indicating the instantaneous discharge amount of the first plunger P1, the region from a point a which is the bottom dead corresponding point Cd to a point c which is the instantaneous discharge amount maximum position is divided into two front and rear regions. A front half is a region from the point a to a point b at which the instantaneous discharge amount suddenly increases after gradually increasing and the gradient of the curve becomes the maximum value, and a rear half is a region from the point b to the point c at which the gradient of the curve becomes loose, the instantaneous discharge amount gradually increases, but the increment gradually decreases and the instantaneous discharge amount becomes the maximum value. The point c is exactly in the middle between the bottom dead corresponding point Cd and the top dead corresponding point Cu in the cam C.

Meanwhile, a region from the point c which is the instantaneous discharge amount maximum position to a point e which is the top dead corresponding point Cu is also divided into two front and rear regions. In other words, a front half is a region from the point c to a point d at which the instantaneous discharge amount suddenly decreases after gradually increasing and the gradient of the curve becomes the maximum value, and a rear half is a region from the point d to the point e at which the gradient of the curve becomes loose, the decrement gradually decreases, and the instantaneous discharge amount becomes zero. Furthermore, such a change in the instantaneous discharge amount from the point a to the point e is also similarly generated when the piston 1 suctions the fluid W that enters the inside of the cylinder 2.

In this manner, by providing the discharge amount adjustment surface C2 on the cam surface C1, the change in the discharge amount of the fluid W obtained respectively by a set of the first plunger P1 and the third plunger P3 and by a set of the second plunger P2 and the fourth plunger P4, becomes extremely smooth. Accordingly, in a case of adding the discharge amount by each set of the plungers P to obtain the total fluid discharge amount of the fluid pump S, the change in the total discharge amount also becomes smooth and the pulsation is substantially improved.

Furthermore, as illustrated in FIG. 9, when setting the region from the point a to the point c of the solid line associated with the first plunger P1, the predetermined discharge amount of the fluid W should be maintained. In other words, since the volume of the fluid W associated with the region can be obtained by multiplying the cross-sectional area of the cylinder 2 by the stroke of the piston 1, the discharge amounts are equal to each other as the cam strokes are the same. Accordingly, the area of the hatched region in FIG. 5 is set equal to the area of the hatched region in FIG. 9. Since the curved shape in FIG. 5 is different from the curved shape in FIG. 9, the height at the maximum position (point c in FIG. 9) of the instantaneous discharge amount is slightly higher in FIG. 9.

Considering this point, as a result of forming the cam C, as illustrated in FIG. 10, curves of two instantaneous discharge amounts are obtained. One of the curves is a composite curve of the first plunger P1 and the third plunger P3 of which the phases are opposite to each other and the other curve is a composite curve of the second plunger P2 and the fourth plunger P4 of which the phases are opposite to each other. With such a curved shape, the total instantaneous discharge amount obtained by adding the flow rates of both composite curves becomes substantially constant.

However, in order to make the total instantaneous discharge amount obtained by adding the flow rates of both composite curves always constant, it is necessary to further limit the shape of both composite curves. In other words, as illustrated in FIG. 9, the increase modes of the instantaneous discharge amount when the cam C rotates from the point a at the bottom dead corresponding point Cd to the point c which is the instantaneous discharge amount maximum position are inverted to each other with the point b which is the central position between the point a and the point c interposed therebetween. The points b and d are inflection points and the curve from the point a to the point b and the curve from the point b to the point c are configured to be point-symmetric with respect to the point b. Further, the curve from the point c to the point d and the curve from the point d to the point e which is the top dead corresponding point Cu are configured to be point-symmetric with respect to the point d.

In addition to this, the increase mode of the instantaneous discharge amount when the cam C rotates from the point a to the point c and the decrease mode of the instantaneous discharge amount when the cam C rotates from the point c to the point e in FIG. 9 are symmetric to each other with the point c interposed therebetween. In other words, the curve from the point a to the point c and the curve from the point c to the point e are configured to have a shape left-right symmetric to each other with the point c interposed therebetween. With such a configuration, the total instantaneous discharge amount which is the sum of the instantaneous discharge amounts of the first to fourth plungers P1 to P4, becomes substantially constant as illustrated in FIG. 10, and the pulsation is eliminated. The height of the horizontal line indicating the total instantaneous discharge amount in FIG. 10 is an average height position of the total instantaneous discharge amount of the waveform in FIG. 6.

Furthermore, in the fluid pump S having such a configuration, a combination of a first set of the first plunger P1 and the third plunger P3 disposed in opposite directions with one cam C interposed therebetween, and a second set of the second plunger P2 and the fourth plunger P4 which are disposed to be opposite to each other with the cam C interposed therebetween and have a phase difference of a quarter cycle of the cam C with respect to the plungers P1 and P3 of the first set, is a basic configuration. Accordingly, as another embodiment, with one set of the four plungers P, it is also possible to provide four other plungers P having a phase difference of a one-eighth cycle of the cam C from each other.

Second Embodiment

Figure 11:
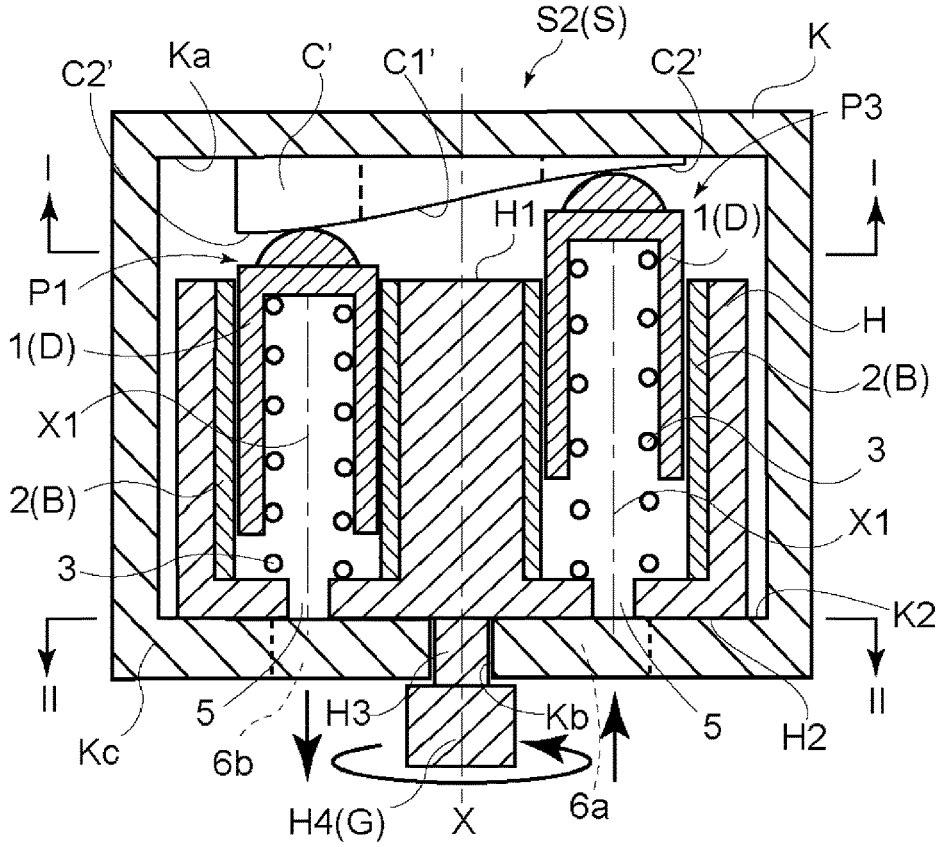
FIG. 11 is an explanatory view illustrating a structure of a radial pump according to a second embodiment.
Figure 12A:
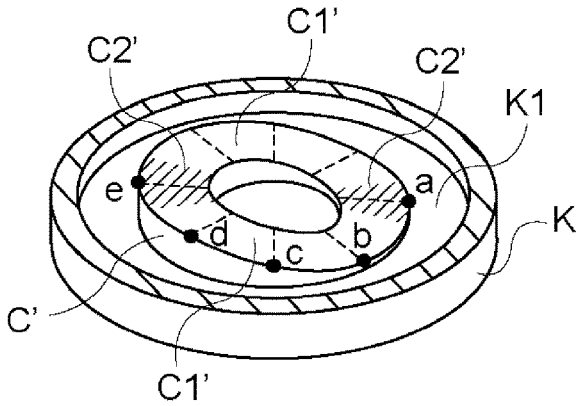
FIGS. 12A and 12B are explanatory views illustrating a configuration of each portion of the radial pump according to the second embodiment.
Figure 12B:
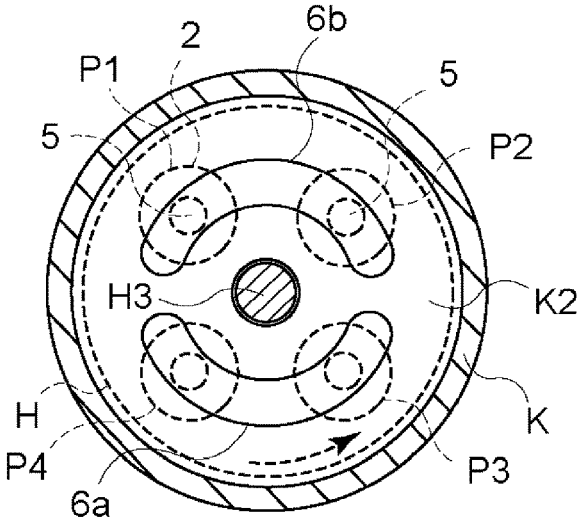

FIGS. 11 and 12 illustrate a second embodiment of the fluid pump S according to the disclosure. The fluid pump S is, for example, an axial pump S2 having four basic configurations of the first plunger P1 to the fourth plunger P4. FIG. 12A is a perspective view illustrating the cam C viewed from I-I line in FIG. 11, and FIG. 12B is a plan view illustrating a bottom wall portion Kc of a casing K viewed from II-II line in FIG. 11.

The first to fourth plungers P1 to P4 are provided in a plunger holder H that rotates around the rotating axis X. Each of the plungers P has the cylinder 2, the piston 1, and the spring member 3 having the same shape, and is disposed with an angular difference of 90 degrees around the rotating axis X. Among the members, the cylinder 2 is configured to be inserted into four cylindrical holes provided in the plunger holder H, for example. The piston 1 is inserted into the cylinders 2 in a state where the spring member 3 is disposed on the inside of the cylinders 2.

A reciprocating axis X1 in which the piston 1 reciprocates in each of the plungers P is parallel to each other. In addition, the distance between the rotating axis X and each of the reciprocating axis X1 is set to be the same in the example of FIG. 11. However, since the piston 1 may perform the desired protrusion and retraction operation corresponding to a rotational angular speed of the plunger holder H, the position of the piston 1 in a diameter direction of an annular cam surface C1' is any position.

The four pistons 1 are exposed from one first end surface H1 along the rotating axis X on the outer surface of the plunger holder H in a state where the protrusion amount can be changed. Meanwhile, on the other second end surface H2 along the rotating axis X on the outer surface of the plunger holder H, four openings 5 that communicate with each of the cylinders 2 are formed as illustrated in FIGS. 11 and 12. The ports serve as the suction port 6*a* and the discharge port 6*b* of the fluid W.

As illustrated in FIG. 11, the plunger holder H is contained in the casing K. From the second end surface H2 of the plunger holder H, a rotary shaft H3 protrudes in a state of penetrating the bottom wall portion Kc of the casing K. The rotary shaft H3 penetrates a bearing portion Kb formed in the bottom wall portion Kc of the casing K and protrudes to the outside. The end portion of the rotary shaft H3 is provided with a drive transmission section H4, such as a gear that receives a rotational driving force from the driving section G (not illustrated).

An annular cam C' is disposed on a first inner surface Ka which the first end surface H1 of the plunger holder H faces, in the casing K. The annular cam surface C1' is formed in the annular cam C' along a rotational trajectory of each piston 1. The annular cam surface C1' is tilted, for example, as illustrated in FIG. 11, in a direction perpendicular to the rotating axis X. By tilting the annular cam surface C1' in this manner, every time the specific plunger P makes one rotation around the rotating axis X, the supply and discharge of the fluid W by the piston 1 is performed one time.

As illustrated in FIGS. 11 and 12, the annular cam surface C1' of the embodiment is not a simple inclined surface, but the same discharge amount adjustment surface C2' (hatched region in FIG. 12A) as that in the first embodiment is provided. For example, when the plunger holder H rotates, as illustrated in FIG. 12A, the fluid W is discharged in a case where the specific plunger P moves from the point a to the point e. At the point a, the height of the annular cam surface C1' gently increases, and at the point c via the point b, a maximum gradient angle is achieved. After this, the gradient becomes loose at the point d and the gradient becomes zero again at the point e. The region on the opposite side of the annular cam surface C1' that forms a suction stroke is configured as a line object with respect to a straight line that connects the point a and the point e to each other.

With the configuration, the suction mode and the discharge mode of the fluid W are the same as those illustrated in the previous first embodiment, and the discharge flow rate of the fluid W becomes constant.

Further, in the configuration, the four plungers P1 to P4 rotate, and the opening 5 of the cylinder 2 sequentially communicates with the suction port 6*a* and the discharge port 6*b*. Accordingly, the supply passage R1 and the discharge passage R2 may be formed at least one by one in the casing K, and the structure of the piping laying is simplified. Furthermore, as described in the first embodiment, it is not necessary to provide the check valve in each of the supply passage R1 and the discharge passage R2, and further to simplify the structure.

In a case of the fluid pump S of the configuration, the discharge flow rate of the fluid W can be changed by changing a rotational speed of the plunger holder H. Further, by reversing the rotational direction of the plunger holder H, it is also possible to replace the suction port 6*a* and the discharge port 6*b*. Furthermore, by setting the number of the pistons 1 provided in the plunger holder H to a multiple of four basic configurations, for example, 8, 12, and the like, it is also possible to obtain the fluid pump S having different discharge flow rates while suppressing the pulsation.

Third Embodiment

Overall Outline

In the embodiment, an example using a vane pump S3 as one of the fluid pumps S is illustrated. The vane pump S3 is intended to reduce the generation of vibration or noises by maintaining the discharge flow rate constant particularly in a case of discharging the fluid W and eliminating the pulsation in the piping through which the fluid W flows. Hereinafter, the vane pump S3 will be described with reference to FIGS. 13 to 18.

Entire Configuration

The vane pump S3 of the embodiment includes the rotor r having at least four vanes V and a cam ring Cr having a cam surface Ca on which the tip ends of each of the vanes V slide, on the inside of the casing K. The moving element D is formed by the vanes V and the rotor r.

Rotor

Figure 13:
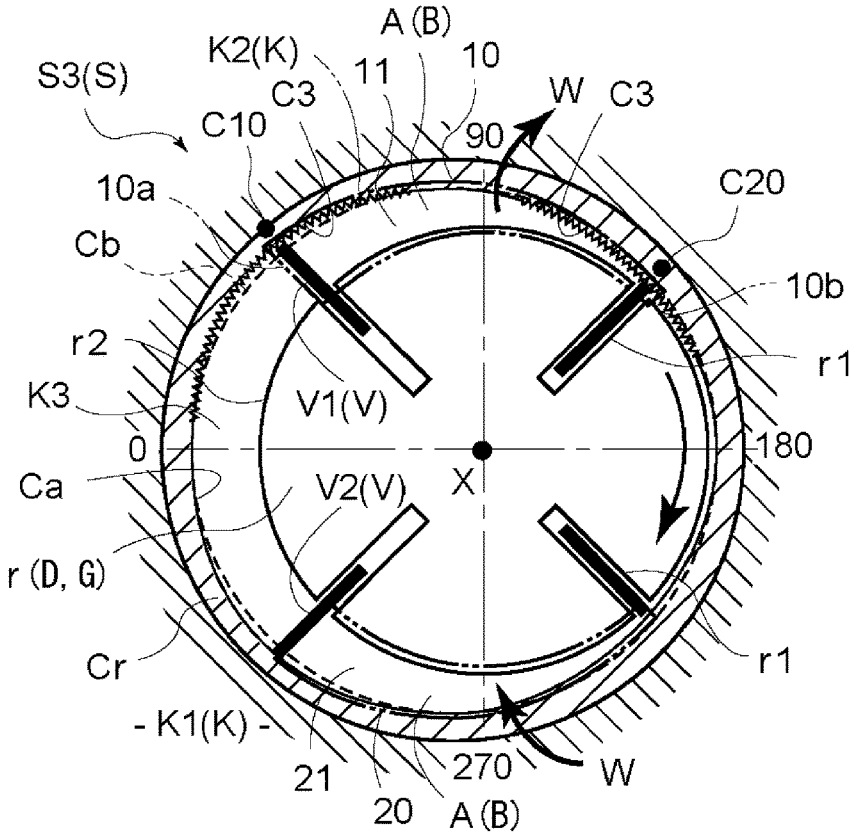
FIG. 13 is an explanatory view illustrating a configuration of a vane pump according to a third embodiment.

As illustrated in FIG. 13, the rotor r has, for example, a columnar side surface and two flat end surfaces, and is rotatable around the rotating axis X. The rotational direction can be changed in accordance with the installation location of the vane pump S3. In an outer peripheral portion, there are provided four groove portions r1 for accommodating the vanes V freely to be protruding and retracting therein. When two vanes V adjacent to each other in the rotational direction are set as one set, the preceding vane V along the rotational direction is referred to as a preceding vane V1 and the following vane V after this is referred to as a following vane V2. The vane V is, for example, a rectangular flat plate member and can slide smoothly in the radial direction along the groove portion r1. An outer edge portion of the vane V is in slidable contact with the cam surface Ca of the cam ring Cr. In the vane pump S3 of the disclosure, it is preferable that the number of vanes V is set to a multiple of 4, for example, setting of the number to 8 or 16 sheets.

Cam Ring

As illustrated in FIG. 13, the cam ring Cr is, for example, an annular member, and the cam surface Ca on which the vane V is in slidable contact with the inner peripheral surface is formed. The cam surface Ca is substantially circular and the center thereof is provided at a position eccentric to the rotating axis X of the rotor r. The cam ring Cr forms a discharge chamber 11 for discharging the fluid W and a suction chamber 21 for suctioning the fluid W between the rotor r and the vane V. Among the chambers, in particular, the discharge chamber 11 functions as the volume chamber B.

Casing

The cam ring Cr is fixed to the inner surface the casing K, and the casing K includes a bearing portion (not illustrated) for rotating the rotor r in a state of being eccentric to the cam ring Cr. The shaft portion of the rotor r extends to the outside of the rotor r, and a drive gear or the like is connected so as to be rotationally driven by the driving section G (not illustrated).

Further, the casing K is divided, for example, in the same plane as the plane perpendicular to the rotating axis X on the outer surface of the rotor r. In one casing K1, a concave portion K3 in which the rotor r is installed is formed. In the other casing K2, as illustrated by the two-dot chain line in FIG. 13, the discharge port 10 and the suction port 20 which are open to a space between the outer peripheral surface r2 of the rotor r and the cam surface Ca are formed. A discharge passage (not illustrated) that communicates with the discharge chamber 11 for discharging the fluid W is connected to the discharge port 10. A suction passage (not illustrated) that communicates with the suction chamber 21 for suctioning the fluid W is connected to the suction port 20. In particular, at the discharge port 10, the edge portion on the upper side in the rotational direction is an upper edge portion 10*a* and the edge portion on the lower side in the rotational direction is a lower edge portion 10*b*.

As illustrated in FIG. 13, the direction in which the rotating axis X of the rotor r is eccentric to the cam surface Ca, that is, the position where the cam surface Ca and the outer peripheral surface r2 of the rotor r are closest to each other, is set as a position where the rotation angle of the rotor r is 180 degrees, the discharge port 10 is formed over a range from a 45-degree position to a 135-degree position. Similarly, the suction port 20 is formed over the range from 225 degrees to 315 degrees. Accordingly, when the rotor r is in the state illustrated in FIG. 13, a vane chamber A which is at a position of 0 degrees and 180 degrees is instantaneously shielded, the vane chamber A which is at a position of 90 degrees is in a discharge state, and the vane chamber A which is at a position of 270 degrees is in a suction state.

Figure 14A:
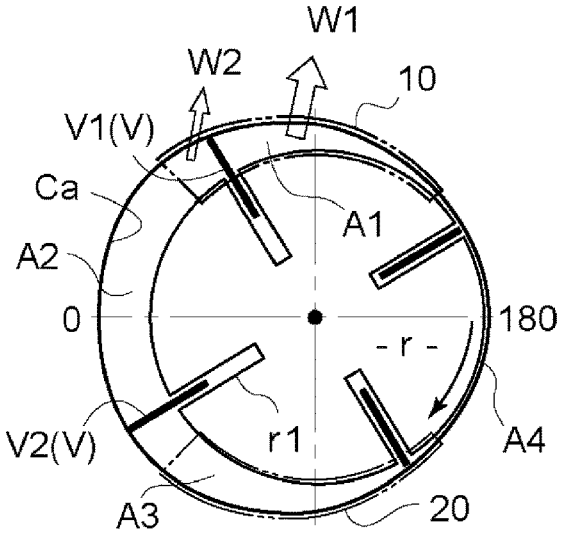
FIGS. 14A and 14B are explanatory views illustrating an operation mode of the vane pump according to the third embodiment.
Figure 14B:
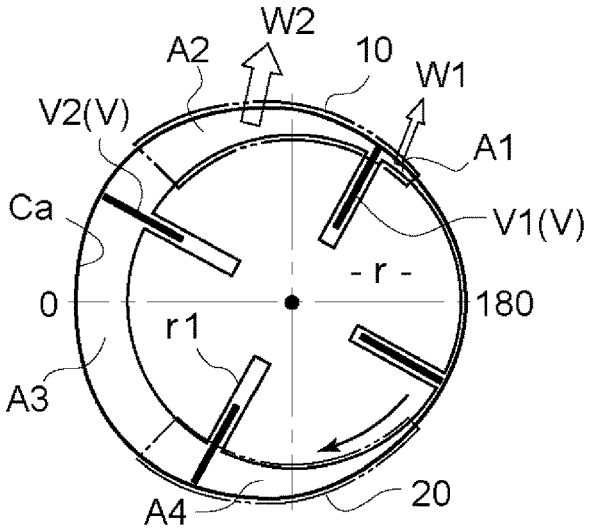

In the vane pump S3 formed in this manner, the state where the discharge of the fluid W is started and the state where the discharge of the fluid W is ended are illustrated in FIGS. 14A and 14B, respectively. FIG. 14A illustrates a state where one vane V overlaps the discharge port 10, a fluid W1 in a first vane chamber A1 is discharged, and a fluid W2 in a second vane chamber A2 starts to be discharged. Meanwhile, FIG. 14B illustrates a state where the vane V approaches an end portion of the discharge port 10, the discharge amount of the fluid W2 from the second vane chamber A2 increases, and the fluid W1 in the first vane chamber A1 is in a state immediately before the discharge is ended.

Discharge Amount Adjustment Surface

In the embodiment, as illustrated in FIG. 13, the cam surface Ca is based on a perfect circle and a predetermined region on the cam surface Ca is formed in a shape different from a perfect circle. On the cam surface Ca, while a position that corresponds to the upper edge portion 10*a* of the discharge port 10 is a first position C10 and a position that corresponds to the lower edge portion 10*b* is a second position C20, a discharge amount adjustment surface C3 in which the change in an inner diameter is reduced along a moving direction of the vane V as indicated by the broken line is provided at least in a region that reaches a position in the vicinity of the lower side in the rotational direction from the first position C10 and in a region that reaches a position in the vicinity of the upper side in the rotational direction from the second position C20.

Furthermore, FIG. 13 illustrates an example in which the discharge amount adjustment surface C3 is provided on both sides along the peripheral direction with the first position C10 on the cam surface Ca interposed therebetween and on both sides along the peripheral direction with the second position C20 interposed therebetween, respectively.

Figure 15A:
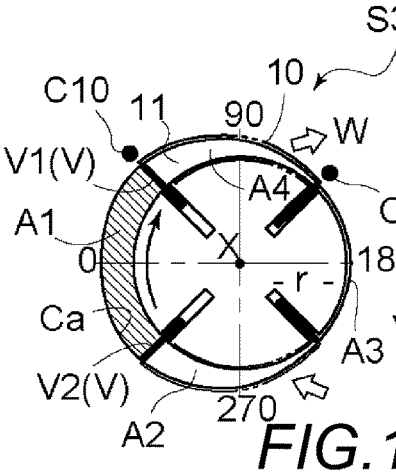
FIGS. 15A to 15E are explanatory views illustrating the operation mode of the vane pump according to the third embodiment.
Figure 15B:
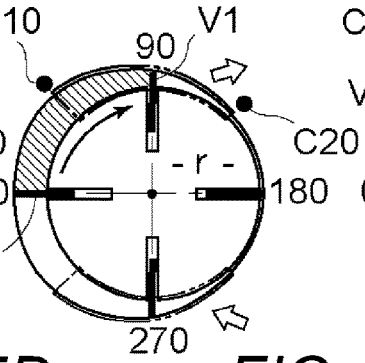
Figure 15C:
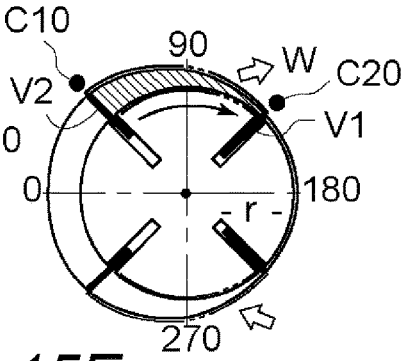
Figure 15D:
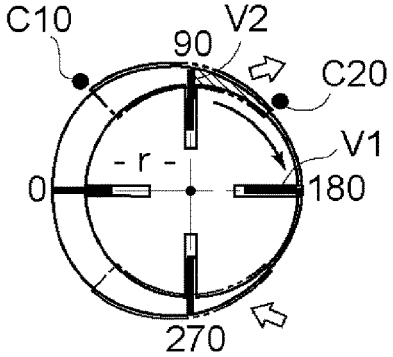
Figure 15E:
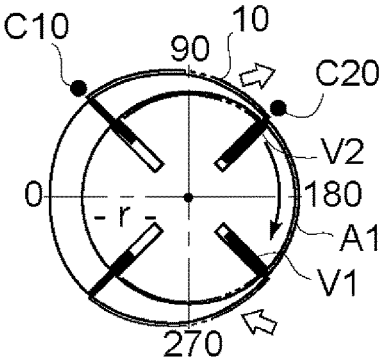

FIGS. 15A to 15E illustrate aspects in which the discharge chamber 11 moves with the volume change in association with the rotation of the rotor r. For two vanes V that form one vane chamber A, the preceding vane along the rotational direction of the rotor r is the preceding vane V1 and the following vane is the following vane V2. FIG. 15A illustrates a state where the preceding vane V1 of the first vane chamber A1 is at the first position C10 of the cam surface Ca, and a phase of the rotor r at this time is a first phase. In addition, FIG. 15E illustrates a state where the following vane V2 of the first vane chamber A1 moves to the second position C20 of the cam surface Ca, and a phase of the rotor r at this time is a second phase. In other words, while the rotor r shifts from the first phase to the second phase, the fluid W in the first vane chamber A1 is discharged from the discharge port 10.

Vane Pump Having Perfect Circular Cam Surface in Related Art

Furthermore, before describing the operation of the vane pump S3 of the embodiment, the operation of the vane pump S3 having the perfect circular cam surface Ca in the related art will be described. FIGS. 24A to 24E illustrate aspects in which the rotor r shifts from the first phase to the second phase. In addition, FIG. 25 is a graph illustrating a change in the volume of each vane chamber A, FIG. 26 is a graph illustrating a change in the instantaneous discharge and suctioning amount of each vane chamber A, and FIG. 27 is a graph illustrating the change in the instantaneous discharge amount of each vane chamber A and the total instantaneous discharge amount of the entire vane pump S3.

Figure 25:
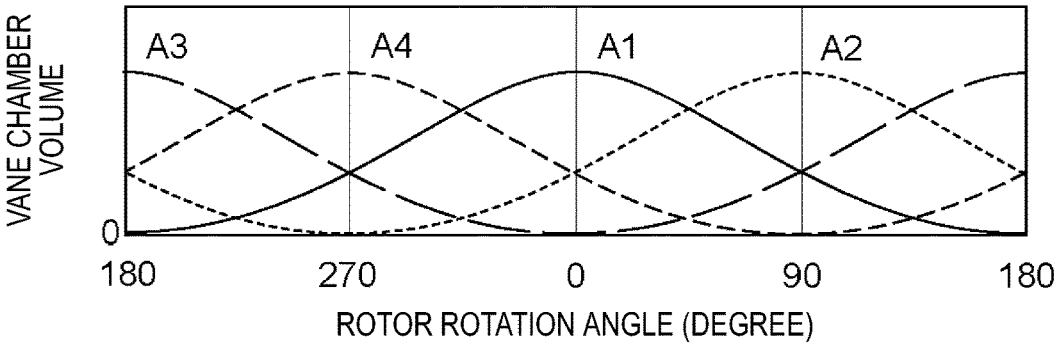
FIG. 25 is a graph illustrating a change in an inter-vane volume of the vane pump of the related art.

In FIG. 25, the horizontal axis represents the rotation angle of the rotor r, and the vertical axis represents the volume of the vane chamber A. The volume of the vane chamber A is set to be zero when the rotor r is in the second phase and to be greater as moving toward the first phase. When one rotation of the rotor r is one cycle, the volume change of each vane chamber A is delayed by a quarter cycle sequentially. The curve of the volume change of the vane chamber A is similar to the sine curve.

Figure 26:
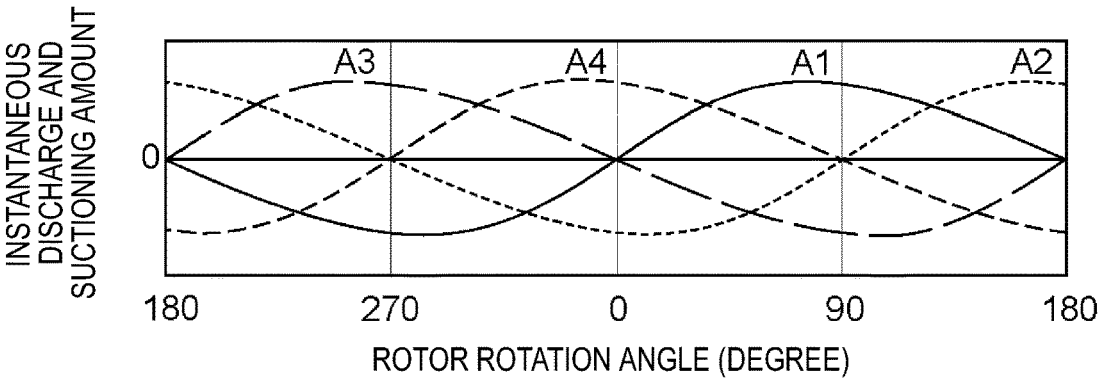
FIG. 26 is a graph illustrating a change in an instantaneous discharge and suctioning amount of the vane pump of the related art.

FIG. 26 illustrates the instantaneous flow rate of the fluid W that is suctioned into or discharged from the vane chamber A. In other words, a curve in FIG. 26 is similar to the curve obtained by differentiating the curve in FIG. 25 with the rotation angle of the rotor r.

Figure 27:
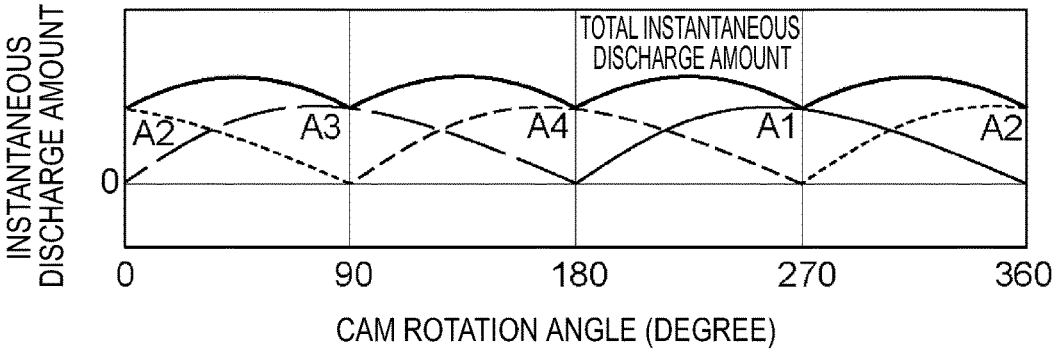
FIG. 27 is a graph illustrating a change in an instantaneous discharge amount of the vane pump of the related art.

In FIG. 27, in the curve illustrated in FIG. 26, a part at which the fluid W is suctioned into the four vane chambers A is omitted, and only the instantaneous discharge amount at which the fluid W is discharged is described. Furthermore, the bold line that changes to a waveform in the drawing indicates the total instantaneous discharge amount obtained by adding the four curves. The up-down change of the total instantaneous discharge amount expresses the presence of the pulsation.

In a case where the cross-sectional shape of the cam surface Ca is a perfect circle, as illustrated in FIG. 27, the curve indicating the total instantaneous discharge amount has a shape obtained by simply connecting substantially arc-shaped curves. In this case, the curve is bent at an acute angle particularly at the moment when the discharge amount decreases and turns to an increase again. Here, the total instantaneous discharge amount suddenly changes and the constant pulsation is generated.

In order to reduce the pulsation, for example, the number of vane chambers A may be increased. By doing so, the increase and decrease amount of the fluid W discharged by each of the vane chambers A is mitigated, and the cycle of the pulsation is shortened. However, only by simply increasing the number of vane chambers A, it is not possible to completely eliminate the pulsation. Here, in the embodiment, the sectional shape of the cam surface Ca which is a perfect circle is corrected as described below.

Vane Pump which Formed Discharge Amount Adjustment Surface on Cam Surface in Case where Instantaneous Discharge Amount Becomes Maximum Value in Central Phase Immediately after the rotor r rotates and reaches the first phase, the discharge of the fluid W in the first vane chamber A1 is started, and after this, the instantaneous discharge amount of the fluid W increases and decreases such that the rotor r reaches the second phase, and the discharge of the fluid W becomes zero. In the embodiment, by forming the discharge amount adjustment surface C3, when the rotor r reaches a state illustrated in FIG. 15C, that is, when the rotor r has reached the phase exactly in the middle between the first phase and the second phase, the instantaneous discharge amount of the fluid W becomes the maximum value. Furthermore, the phase in the middle is referred to as a maximum discharge phase.

As illustrated in FIG. 13, specifically, the discharge amount adjustment surface C3 is formed on both sides in the peripheral direction with the first position C10 on the cam surface Ca interposed therebetween and on both sides in the peripheral direction with the second position C20 interposed therebetween. Here, on the first position C10 side, as illustrated in FIG. 13, the inner diameter is formed to be greater than that of the virtual cam surface Cb (indicated by the dotted line) of a perfect circle. In particular, on the lower side of the first position C10, the diameter is slightly greater than that of the cam surface Cb, and the diameter is reduced more gently than a diameter reduction ratio of the cam surface Cb. In other words, the cam surface Ca is configured so as to mitigate the speed at which the vane V enters the groove portion r1.

Here, on the second position C20 side, as illustrated in FIG. 13, the inner diameter is formed to be smaller than that of the virtual cam surface Cb of a perfect circle. In particular, on the upper side of the second position C20, the diameter is slightly smaller than that of the cam surface Cb. Furthermore, by reducing the diameter from the previous position of the second position C20 in advance, the diameter is reduced more gently than the diameter reduction ratio of the cam surface Cb. In this case, the speed at which the vane V enters the groove portion r1 is also mitigated.

With such a configuration, after the vane V that has passed through the first position C10 moves for a while and the speed of entering the groove portion r1 suddenly increases. In addition, the speed at which the vane V that approaches the second position C20 enters the groove portion r1 previous to the second position C20 is mitigated. As a result, the change in volume of the vane chamber A immediately after the first position C10 and previous to the second position C20 is mitigated. On the other hand, in the vicinity of the center position between the first phase and the second phase, a state where the instantaneous discharge amount suddenly increases in order to ensure the discharge amount of the fluid W and then suddenly decreases, appears. In other words, while the rotor r reaches the maximum discharge phase from the first phase, a state where the instantaneous discharge amount suddenly increases and a state where the instantaneous discharge amount gradually increases appear consecutively, and while the rotor r reaches the second phase from the maximum discharge phase, a state where the instantaneous discharge amount suddenly decreases and a state where the instantaneous discharge amount gradually decreases appear consecutively.

Moreover, in the embodiment, when the rotor r has reached the phase exactly in the middle between the first phase and the second phase, the cam surface Ca is formed such that the instantaneous discharge amount of the fluid W becomes the maximum value. The shape of the cam surface Ca is determined by calculating the change of the vane chamber A formed by the rotor r, the vane V, and the cam surface Ca in accordance with the rotation angle of the rotor r.

Figure 16:
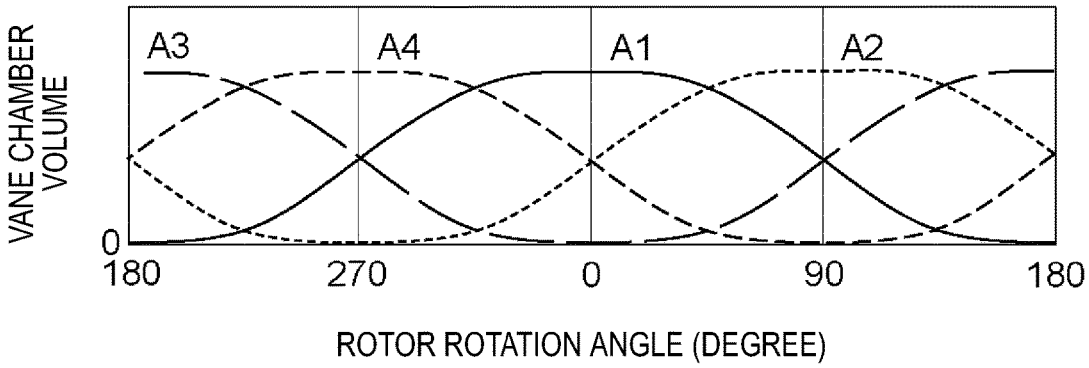
FIG. 16 is a graph illustrating a change in an inter-vane volume of the vane pump of the third embodiment.
Figure 17:
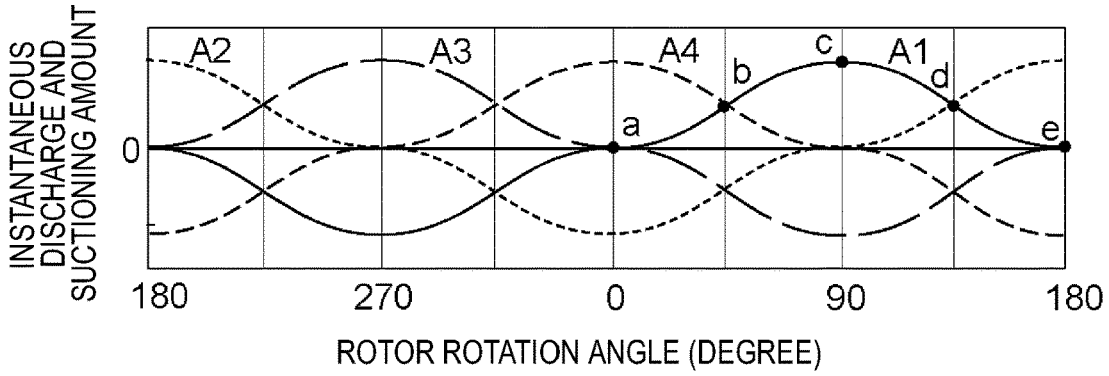
FIG. 17 is a graph illustrating a change in an instantaneous discharge and suctioning amount of the vane pump of the third embodiment.

The above-described configuration will be described specifically using a graph. FIG. 16 is a graph illustrating a change in the volume of each vane chamber A in a case of using the cam ring Cr of the embodiment illustrated in FIG. 13, FIG. 17 is a graph illustrating a change in the instantaneous discharge and suctioning amount of each vane chamber A, and FIG. 18 is a graph illustrating the instantaneous discharge amount and the total instantaneous discharge amount of each vane chamber A.

Figure 18:
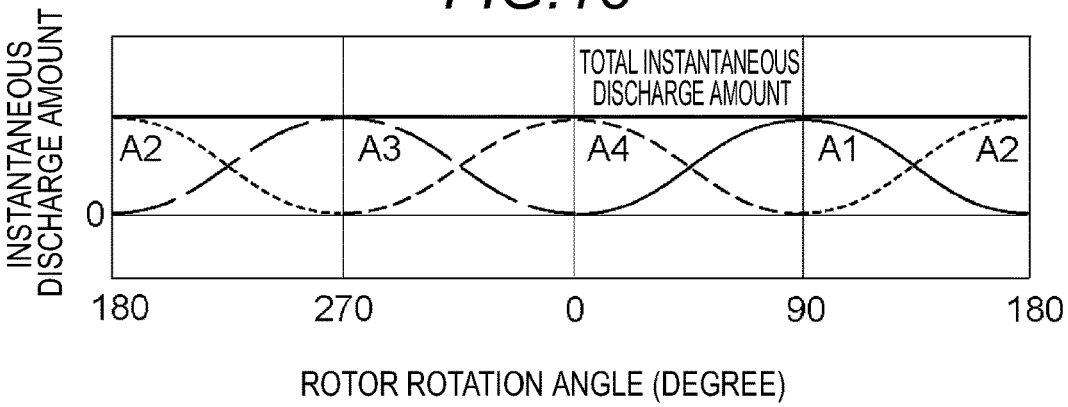
FIG. 18 is a graph illustrating a change in an instantaneous discharge amount of the vane pump of the third embodiment.

In order to make the total instantaneous discharge amount constant as illustrated in FIG. 18, it is necessary to appropriately set the curve of the instantaneous discharge amount of each of the vane chambers A. Specifically, when the instantaneous discharge amount reaches zero and when the instantaneous discharge amount reaches the maximum value, the degree of change in the instantaneous flow rate is reduced. As illustrated in FIG. 18, for example, when expressing the instantaneous discharge amount of each of the vane chambers A, each curve has a shape that is in contact with the horizontal axis on which the instantaneous discharge amount is zero and the horizontal axis indicating the total instantaneous discharge amount.

As illustrated in FIG. 13, such a curve of the instantaneous discharge amount can be obtained by forming the discharge amount adjustment surface C3 as indicated by the broken line at the first position C10 and the second position C20. By configuring the shape of the cam surface Ca in this manner, when the rotor r reaches the second phase from the first phase, the volume change amount (instantaneous discharge amount from the vane chamber A) of the vane chamber A with respect to the unit rotation angle of the rotor r becomes the maximum value at the position between the first phase and the second phase. In other words, as illustrated in FIG. 17, in the solid line indicating the instantaneous discharge amount of the first vane chamber A1, for example, the maximum discharge phase is achieved at the point c exactly at the intermediate position between the point at which is the first phase and the point e which is the second phase.

With the configuration, it becomes the easiest to balance the process of increasing and decreasing the discharge amount of the fluid W. In particular, since the maximum discharge phase is exactly at the intermediate position between the first phase and the second phase, by providing the discharge amount adjustment surface C3 in the vicinity of the first position C10 and in the vicinity of the second position C20 in the shape of the cam surface Ca, it becomes easy to balance a discharge increase amount and a discharge decrease amount of the fluid W with respect to the unit rotation angle of the rotor r. Accordingly, the vane pump S3 with the small pulsation of the fluid W can be obtained.

Inflection Point in Middle of First Phase and Maximum Discharge Phase and Middle of Maximum Discharge Phase and Second Phase Further, the shape of the discharge amount adjustment surface C3 can be further configured as follows. In other words, when the rotor r rotates from the first phase to the maximum discharge phase, the instantaneous discharge amount is switched from a sudden increase to a gradual increase at the central phase between the first phase and the maximum discharge phase. Further, when the rotor r rotates from the maximum discharge phase to the second phase, the instantaneous discharge amount is switched from a sudden decrease to a gradual decrease at the central phase between the maximum discharge phase and the second phase.

For example, as illustrated in FIG. 17, with respect to the solid line indicating the instantaneous discharge amount of the first vane chamber A1, the region from the point at which is the first phase to the point c which is the maximum discharge phase is divided into two front and rear regions. A front half is a region from the point a to the point b at which the instantaneous discharge amount suddenly increases after gradually increasing and the gradient of the curve becomes the maximum value, and a rear half is a region from the point b to the point c at which the gradient of the curve becomes loose, the instantaneous discharge amount gradually increases, but the increment gradually decreases and the instantaneous discharge amount becomes the maximum value. The point c is the maximum discharge phase.

Meanwhile, a region from the point c which is the maximum discharge amount phase to the point e which is the second phase is also divided into two front and rear regions. In other words, a front half is a region from the point c to the point d at which the instantaneous discharge amount suddenly decreases after gradually increasing and the gradient of the curve becomes the maximum value, and a rear half is a region from the point d to the point e at which the gradient of the curve becomes loose, the decrement gradually decreases, and the instantaneous discharge amount becomes zero. Furthermore, such a change in the instantaneous discharge amount from the point a to the point e is similarly generated when the vane chamber A suctions the fluid W exposed at the suction port 20.

In this manner, by providing the discharge amount adjustment surface C3 on the cam surface Ca, the change in the discharge amount of the fluid W obtained respectively by a set of the first vane chamber A1 and the third vane chamber A3 and by a set of the second vane chamber A2 and the fourth vane chamber A4, becomes extremely smooth. Accordingly, in a case of adding the discharge amount by each set of the vane chambers A to obtain the total fluid discharge amount of the vane pump S3, the change in the total discharge amount also becomes smooth and the pulsation is substantially improved.

Considering this point, as a result of forming the cam surface Ca, as illustrated in FIG. 18, curves of two instantaneous discharge amounts are obtained. One of the curves is a composite curve of the first vane chamber A1 and the third vane chamber A3 of which the phases are opposite to each other and the other curve is a composite curve of the second vane chamber A2 and the fourth vane chamber A4 of which the phases are opposite to each other. With such a curved shape, the total instantaneous discharge amount obtained by adding the flow rates of both composite curves becomes substantially constant.

In the process of increasing and decreasing the instantaneous discharge amount of the fluid W as in the configuration, by providing changing points of the increasing characteristics and the decreasing characteristics exactly at the center position in the rotation phase of the rotor r, it is possible to bring the change characteristics of the instantaneous discharge amount from the first phase to the maximum discharge phase and the change characteristics of the instantaneous discharge amount from the maximum discharge phase to the second phase to be close to each other more symmetrically. As a result, the state of balance between the discharge increase amount and the discharge decrease amount of the fluid W with respect to the unit rotation angle of the rotor r becomes more appropriate. Accordingly, furthermore, the vane pump S3 with the small pulsation can be obtained.

Point-Symmetry at Center Between First Phase and Maximum Discharge Phase, and Line-Symmetry Interposing Maximum Discharge Phase However, as illustrated in FIG. 18, in order to make the total instantaneous discharge amount obtained by adding the flow rates of both composite curves always constant, it is necessary to further limit the shape of both composite curves. In other words, in the vane pump S3 of the embodiment, it is preferable that the discharge amount adjustment surface C3 is formed such that the increase modes of the instantaneous discharge amount from the first phase to the maximum discharge phase are inverted to each other with the center position between the first phase and the maximum discharge phase interposed therebetween, and the increase mode of the instantaneous discharge amount from the first phase to the maximum discharge phase and the decrease mode of the instantaneous discharge amount from the maximum discharge phase to the second phase are symmetric to each other with the maximum discharge phase interposed therebetween.

In other words, as illustrated in FIG. 17, the increase modes of the instantaneous discharge amount when the rotor r rotates from the point at which is in the first phase to the point c which is in the maximum discharge phase, are inverted to each other with the point b which is at the central position between the point a and the point c interposed therebetween. The points b and d are inflection points and the curve from the point a to the point b and the curve from the point b to the point c are configured to be point-symmetric to the point b. Further, the curve from the point c to the point d and the curve from the point d to the point e which is in the second phase are configured to be point-symmetric to the point d.

In addition to this, the increase mode of the instantaneous discharge amount when the rotor r rotates from the point a to the point c and the decrease mode of the instantaneous discharge amount when the rotor r rotates from the point c to the point e in FIG. 17 are symmetric to each other with the point c interposed therebetween. In other words, the curve from the point a to the point c and the curve from the point c to the point e are configured to have a shape left-right symmetric to each other with the point c interposed therebetween. With such a configuration, the total instantaneous discharge amount which is the sum of the instantaneous discharge amounts of the first to fourth vane chambers A1 to A4, becomes substantially constant as illustrated in FIG. 18, and the pulsation is eliminated.

Fourth Embodiment

In the vane pump S3 illustrated in the third embodiment, as illustrated in FIGS. 14A and 14B, a combination of a first set of the first vane chamber A1 and the third vane chamber A3 which oppose each other with the rotating axis X interposed therebetween, and a second set of the second vane chamber A2 and the fourth vane chamber A4 which are disposed to be opposite to each other with the rotating axis X interposed therebetween and have a phase difference of a quarter cycle of the rotor r with respect to the first vane chambers A1 and the third vane chamber A3 of the first set, is a basic configuration.

Figure 19:
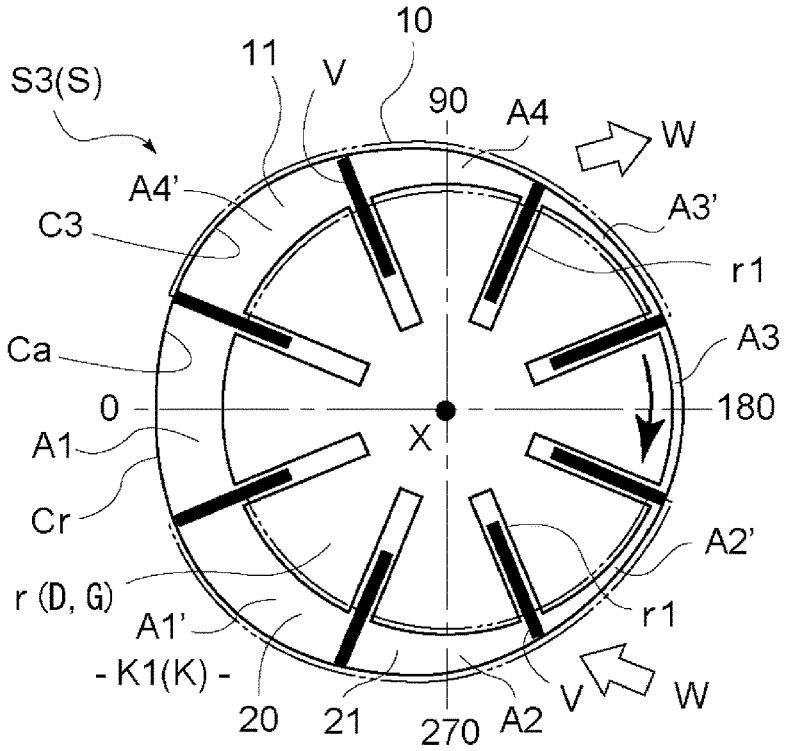
FIG. 19 is an explanatory view illustrating a configuration of a vane pump according to a fourth embodiment.

The concept can be enlarged, and for example, as illustrated in FIG. 19, a structure in which four vane chambers A1 to A4 separated from each other by a quarter cycle are set as one set, another four vane chambers A1' to A4' having the phase difference of one-eighth cycle of the rotor r are provided, and a total of eight vanes V are provided, can be employed. Furthermore, as long as the four vane chambers are formed into one set, the total number of vanes V, such as the vanes with twelve configurations and sixteen configurations, can be set to a multiple of four.

In the configuration, for example, the plurality of vane chambers A4', A4, and A3' are opened at the discharge port 10. As a result, the increase or decrease in the instantaneous discharge amount of the fluid W in each of the vane chambers is canceled out, the pulsation of the fluid W is reduced, and the vane pump S3 with less vibration or noise can be obtained.

Fifth Embodiment

Figure 20:
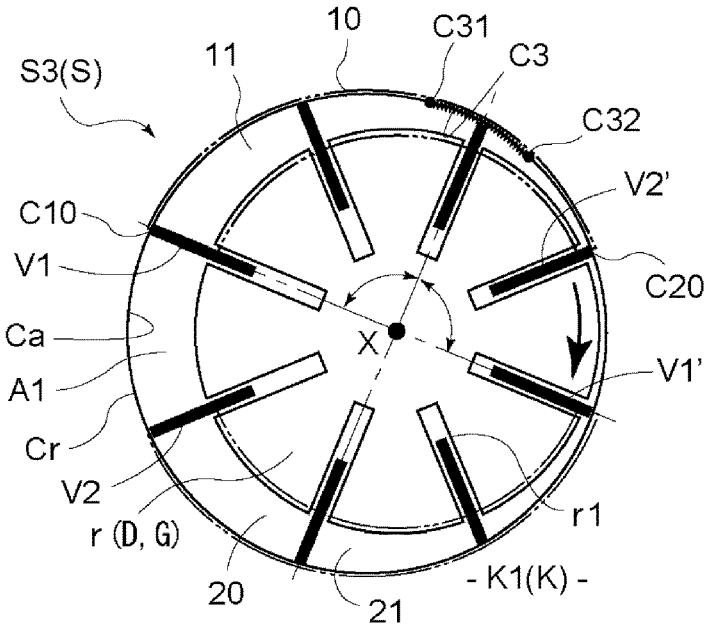
FIG. 20 is an explanatory view illustrating a configuration of a vane pump according to a fifth embodiment.
Figure 21:
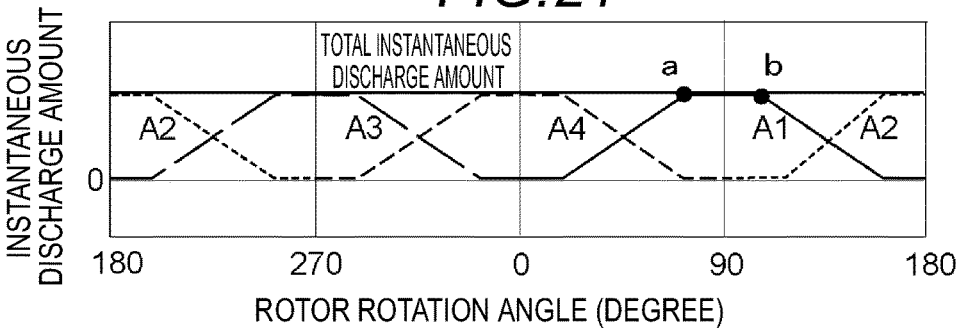
FIG. 21 is a graph illustrating a change in an instantaneous discharge amount of the vane pump of the fifth embodiment.

As the increase mode of the instantaneous discharge amount, for example, as illustrated in FIGS. 20 and 21, it is also possible to employ a mode of changing the shape into a trapezoidal shape. For this, a region where the amount of shrinkage of the inner diameter is mitigated is formed at a part of the cam surface Ca, and the maximum instantaneous discharge amount can be maintained for a certain period.

Specifically, when the angle at which the rotor r rotates from the first phase to the second phase is set as the discharge rotation angle, on the cam surface Ca, the position which is on the lower side only by an angle of half the discharge rotation angle from the first position C10 is specified. In most cases, since the discharge rotation angle is 180 degrees, the position of 90 degrees from the first position C10 is specified. As illustrated in FIG. 20, in the region interposing the position along the rotational direction of the rotor r, the discharge amount adjustment surface C3 (a region of the broken line) in which the degree of reduction in the inner diameter of the cam surface Ca around the rotating axis X of the rotor r becomes slightly loose is formed.

Accordingly, when the preceding vane V1 that configures the vane chamber A1 reaches the end portion C31 of the discharge amount adjustment surface C3 (point a in FIG. 21), the instantaneous discharge amount stops increasing and is maintained as the maximum value while the preceding vane V1 passes through the discharge amount adjustment surface C3 (the region from the point a to the point b in FIG. 21). After this, when the preceding vane V1 passes through an end portion C32 on the lower side of the discharge amount adjustment surface C3 (point b in FIG. 21) and enters the cam surface Ca of which the diameter decreases in a normal mode, the instantaneous discharge amount decreases. Furthermore, when the rotor r rotates and a following vane V2' passes through the second position C20, the instantaneous discharge amount by the vane chamber A1 becomes zero.

With the configuration, it is possible to widen the phase in which the instantaneous discharge amount becomes the maximum value. As a result, the phase region where the instantaneous discharge amount changes becomes narrow, the time period during which the instantaneous discharge amount becomes constant when the rotor r rotates, and the pulsation generated from the entire vane pump S3 becomes small.

Sixth Embodiment

Figure 22:
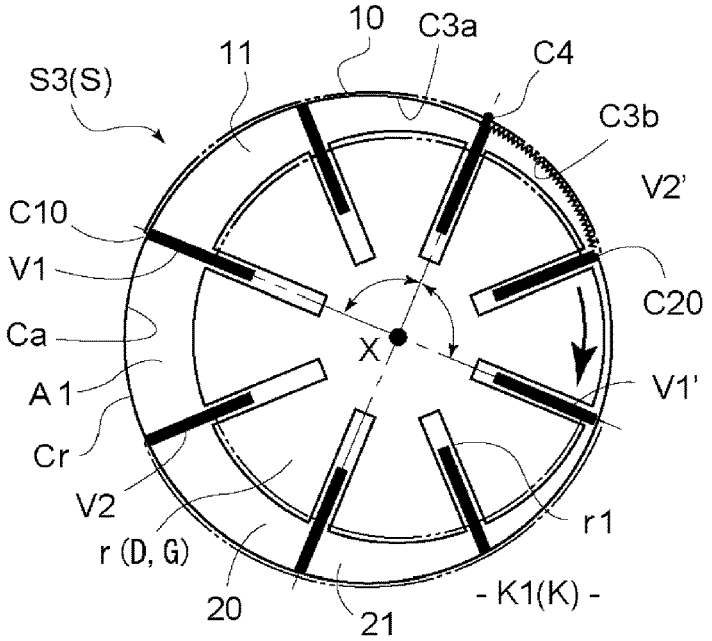
FIG. 22 is an explanatory view illustrating a configuration of a vane pump according to a sixth embodiment.
Figure 23:
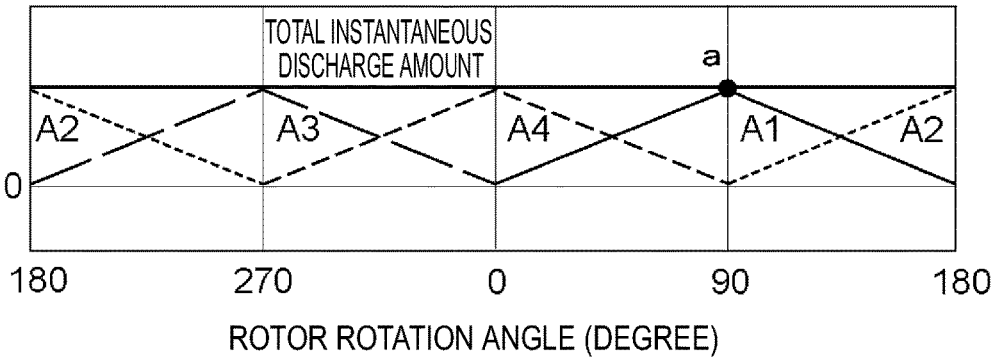
FIG. 23 is a graph illustrating a change in an instantaneous discharge amount of the vane pump of the sixth embodiment.
Figure 24A:
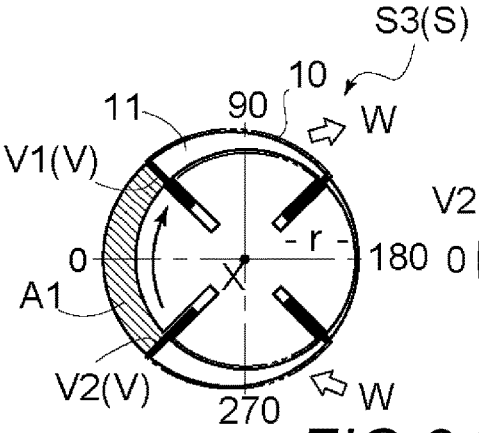
FIGS. 24A to 24E are explanatory views illustrating an operation mode of a vane pump of the related art.
Figure 24B:
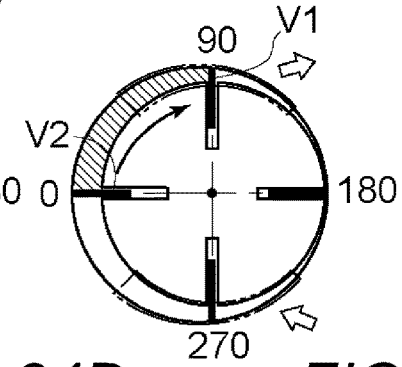
Figure 24C:
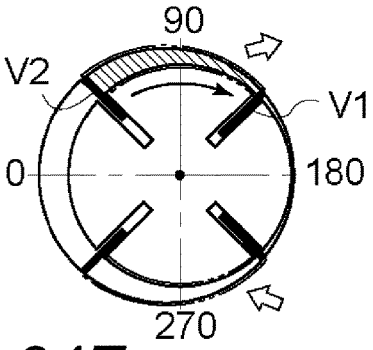
Figure 24D:
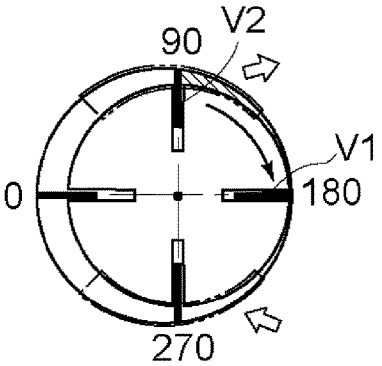
Figure 24E:
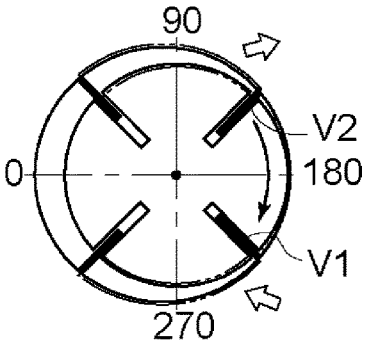

As the increase mode of the instantaneous discharge amount, further, as illustrated in FIGS. 22 and 23, it is also possible to employ a mode of changing the shape into a triangular shape. For this, a configuration in which an inflection point C4 at which the amount of shrinkage of the inner diameter changes is provided at a part of the cam surface Ca, and the instantaneous discharge amount of the fluid W is inverted from the increase to the decrease at the inflection point C4, is employed.

Specifically, on the lower side from the first position C10 of the cam surface Ca, the inflection point C4 is provided at the position separated only by an angle (90 degrees) of half the discharge rotation angle (normally 180 degrees) at which the rotor r rotates from the first phase to the second phase. Until the preceding vane V1 reaches the inflection point C4, a discharge amount adjustment surface C3*a* is formed on the cam surface Ca such that the protrusion amount of the preceding vane V1 with respect to the rotor r becomes short at a predetermined ratio. After passing through the inflection point C4, a discharge amount adjustment surface C3*b* (indicated by the broken line in FIG. 22) is formed so as to slightly mitigate the ratio of the decrease in the protrusion amount. Accordingly, the reduction of the volume of the vane chamber A1 is mitigated, and the instantaneous discharge amount of the fluid W rapidly turns from the increase to the decrease as illustrated by the point a in FIG. 23.

In the configuration, when forming the cam surface Ca, the discharge amount adjustment surface C3*a* for increasing the instantaneous discharge amount and the discharge amount adjustment surface C3*b* for decreasing the instantaneous discharge amount may be formed one by one before and after the inflection point C4. Accordingly, the configuration of the cam surface Ca is simplified, and the manufacturing cost of the vane pump S3 can be reduced.

Furthermore, in FIGS. 21 and 23, the region where the instantaneous discharge amount of the fluid W becomes the maximum value or the part other than the maximum position is indicated by a straight line. However, a case where the regions are curved, that is, a case where the change in the instantaneous discharge amount of the fluid W is smoother, is more effective for decreasing the pulsation of the vane pump S3.

Determination of Number of Volume Chambers and Operating Ratio of Each Volume Chamber As illustrated in each of the above-described embodiments, in order to eliminate the pulsation, when the discharge of the fluid W in the volume chamber B, such as the cylinder 2 or the vane chamber A, is ended, the discharge of the fluid from the other volume chamber B is started, and it is necessary to continuously increase and decrease the instantaneous discharge amount of the fluid W. In the increasing and decreasing characteristics, a plurality of sets of the volume chambers B or the cams C are set by determining the configuration of the volume chamber B or the cam C.

For example, in the first embodiment, an example of the radial pump S1 using four cylinders 2 is illustrated, and in the third embodiment, an example of the vane pump S3 using four vanes V is illustrated. In the examples, as illustrated in FIG. 9 or 17, in the respective cylinders 2 or vane chambers A, the rotation angle of the cam C or the rotation angle of the rotor r when suctioning the fluid W, and both angles when discharging the fluid W are the same as each other. In other words, the time for suctioning and discharging is the same, and in the fluid pump S, the speed change of the piston 1 or the change in the speed of entering and exiting the vane V provided in the rotor r becomes smooth, and it is possible to obtain the fluid pump S that is mechanistically reasonable.

In the examples, as illustrated in FIG. 10 or 18, the discharge of the fluid W is paired with two cylinders 2 or two vane chambers A, and each pair alternately discharges the fluid W. In addition, at the same time, the number of cylinders 2 or vane chambers A which are discharging the fluid W is two, respectively.

However, in the fluid pump S of the disclosure, it is not necessary to equally set the suction time and the discharge time for one volume chamber B. For example, by setting the profile of the cam C, it is possible to set the suction time shorter than the discharge time in each volume chamber B. In this case, the fluid W is suctioned into the volume chamber B at once, and then slowly discharged. However, in a case of considering only the discharge process that particularly influences the pulsation, the pulsation is substantially mitigated by performing the gentle discharge. Here, in the fluid pump S of the disclosure, the number of the volume chambers B and the operating ratios of each of the volume chambers B are determined as follows.

In the fluid pump S of the disclosure, by providing three or more volume chambers B and moving elements D, the fluctuations in pressures of the fluid W generated in each of the volume chambers B cancel out each other, and the fluid pump S having no pulsation as a whole can be obtained.

First, the mode in which the fluid W is discharged for one volume chamber B is determined. The rotation angle that defines the state of discharging the fluid W in one volume chamber B among the one-cycle rotation angles Z of the cam C that defines the discharge time of the fluid W is the discharge rotation angle $\alpha$. The discharge rotation angle $\alpha$ is a rotation angle from the start phase in which the instantaneous discharge amount of the fluid W is zero to the end phase in which the instantaneous discharge amount reaches zero again through the central phase in which the instantaneous discharge amount becomes the maximum value.

When the number of the volume chambers B is M, the discharge rotation angle $\alpha=(Z/M)\times N$ is defined while any integer from 2 to (M−1) is N.

Here, M is an integer equal to or greater than 3 expressing the number of volume chambers B, and N is any integer from 2 to (M−1).

Figure 28:
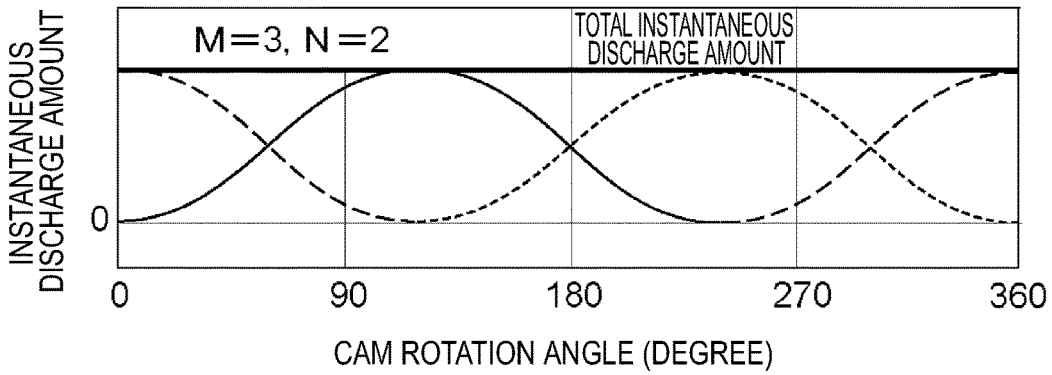
FIG. 28 is a graph illustrating a change in the instantaneous discharge amount in a fluid pump having three volume chambers.
Figure 29A:
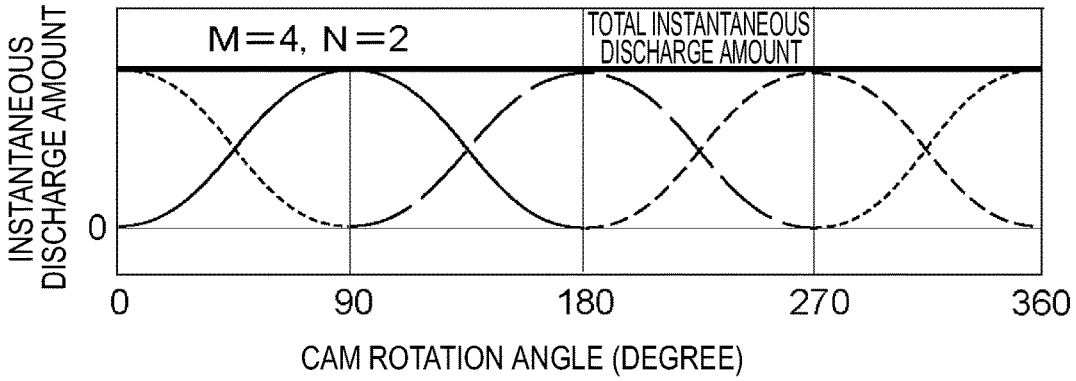
FIGS. 29A to 29C are graphs illustrating a change in the instantaneous discharge amount in a fluid pump having four volume chambers.
Figure 29B:
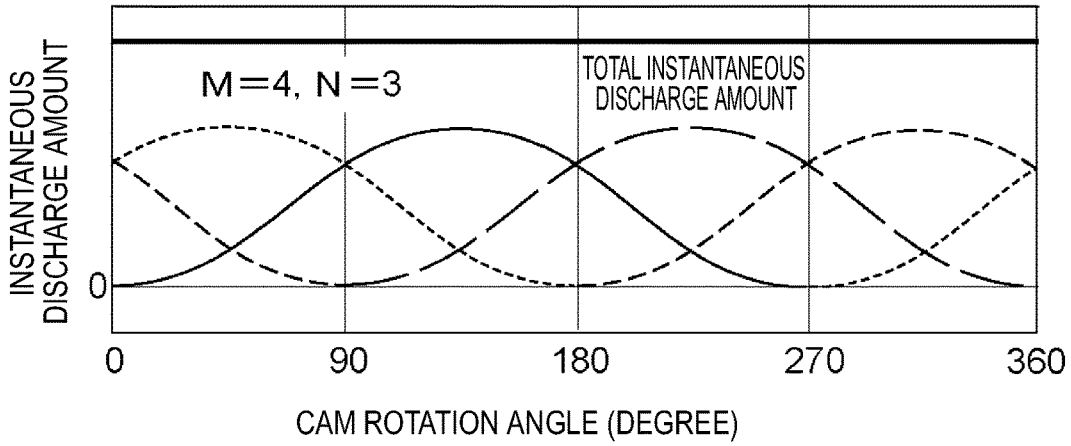
Figure 29C:
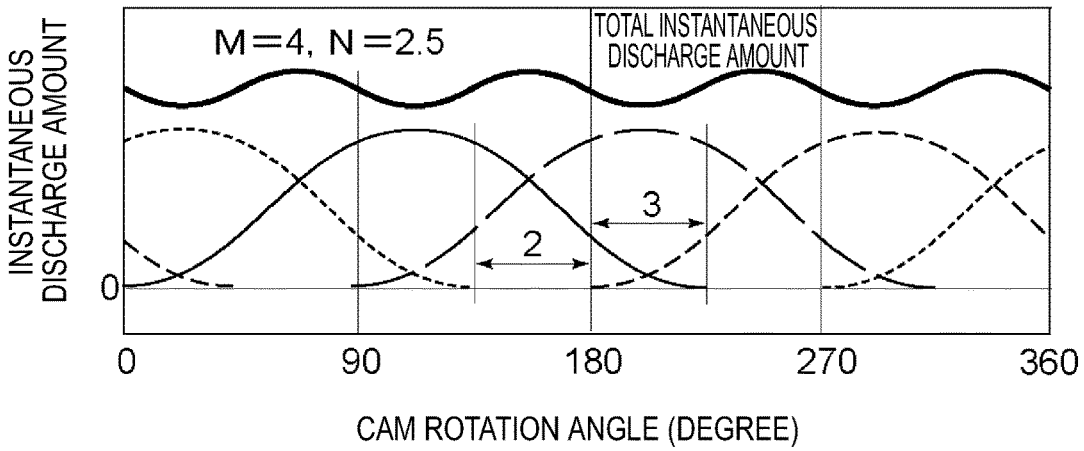
Figure 30A:
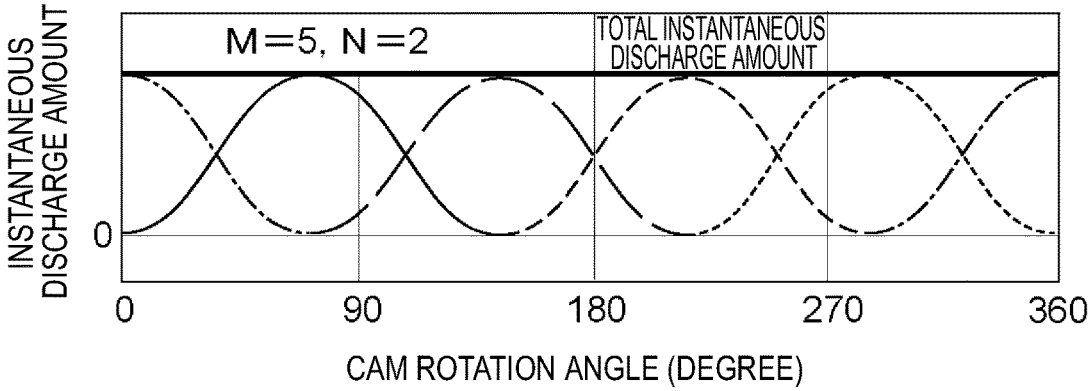
FIGS. 30A to 30C are graphs illustrating a change in the instantaneous discharge amount in a fluid pump having five volume chambers.
Figure 30B:
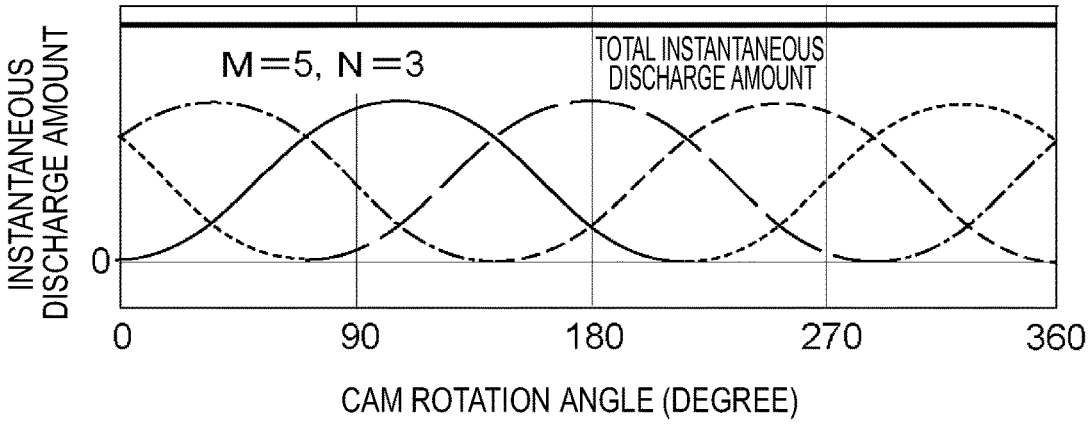
Figure 30C:
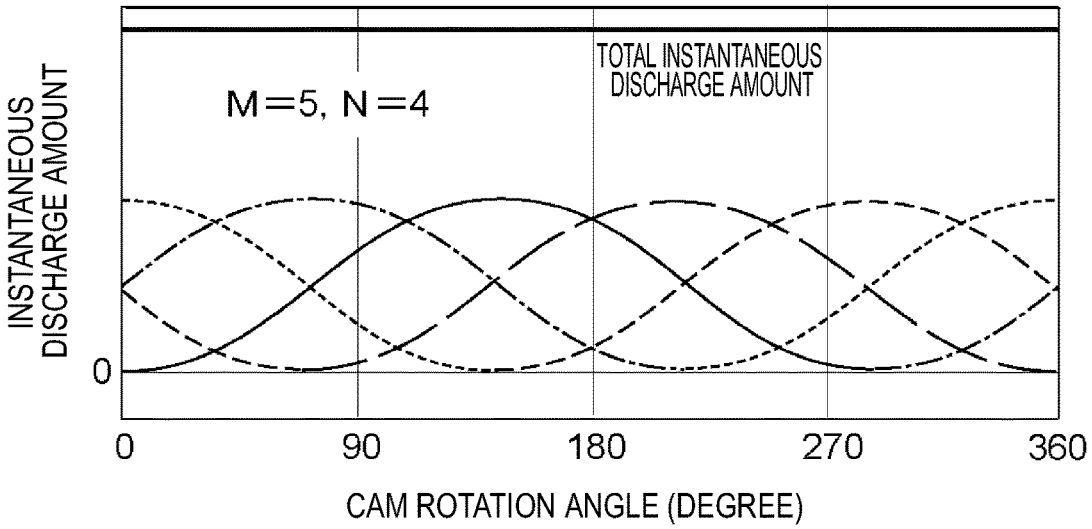

FIG. 28 illustrates the relationship between the cam rotation angle and the instantaneous discharge amount, for example, in the radial pump S1 having three cylinders 2. Similarly, FIGS. 29A, 29B, and 29C illustrate a case of the radial pump S1 having four cylinders 2, and FIGS. 30A, 30B, and 30C illustrate a case of having five cylinders 2.

The value of Z/M is a difference in the rotation angle at which each of the volume chambers B performs a discharge operation in one cycle. For example, in a case where M=4 and the one-cycle rotation angle Z=360 degrees, as illustrated in FIGS. 29A to 29C, the discharge operation of each of the volume chambers B is performed every time the cam C rotates by 90 degrees.

Meanwhile, the N value indicates how many volume chambers B are in a discharge state at a certain timing. Accordingly, as the N value increases, one volume chamber B discharges the fluid W over a long rotation angle.

N=1 is not satisfied. In a case of N=1, one volume chamber B always discharges the fluid W, the pulsation is constantly generated in the discharge operation of one volume chamber B as described above, and thus, even when the discharge of the volume chamber B is continuous, it is not possible to eliminate the pulsation.

Meanwhile, N=M is not satisfied, either. N=M means that the fluid W is constantly discharged from all of the volume chambers B, and it is not possible to ensure a period for suctioning the fluid W for each of the volume chambers B.

Therefore, as illustrated in FIG. 28, in a case of M=3, the number N of the volume chambers B in the discharge state becomes 2 at the same time. In addition, as illustrated in FIGS. 29A to 29C, in a case of M=4, the number N of the volume chambers B in the discharge state is 2 or 3 at the same time. Furthermore, as illustrated in FIGS. 30A to 30C, in a case of M=5, the number N of the volume chambers B in the discharge state is 2 to 4 at the same time.

Furthermore, the N value is an integer. In other words, since a case where one volume chamber B is in a discharge state by half is not possible, as illustrated in FIG. 29C, the fact that the N value becomes a small number means that three volume chambers B are in the discharge state at a certain moment and two volume chambers B are in the discharge state at another moment, the discharge state is not constant, and the pulsation cannot be eliminated. Accordingly, N is an integer between 2 and (M−1).

When any one of the volume chambers B has reached the end phase after satisfying the above-described condition, it is necessary that the volume chamber B from which the N-th discharge is started following the volume chamber B reaches the start phase. For example, in a case of N=2, at a certain moment, the specific volume chamber B is in the discharge state together with other volume chambers B which started the discharge earlier than the specific volume chamber B itself. When it is attempted to make the total discharge amount constant at the time of the discharge start and the discharge end of each of the volume chambers B, when the specific volume chamber B just starts the discharge, it is necessary that the other volume chamber B ensures a predetermined discharge amount.

Then, the discharge work of the specific volume chamber B is added to the discharge work of the volume chamber B which started the discharge one before the specific volume chamber B itself in the middle, and after the discharge work of one previous volume chamber B is ended, the volume chamber B that starts the discharge work one after the specific volume chamber B itself is replaced with the volume chamber B, and the decrease in the discharge amount of the specific volume chamber B itself is compensated by the discharge of the volume chamber B one after the specific volume chamber B itself. Furthermore, when the discharge of the specific volume chamber B itself is ended, the volume chamber B is switched to the volume chamber B which starts the discharge volume chambers B two behind the specific volume chamber B itself.

In this manner, in order for N volume chambers B to perform the discharge work at all times, when the specific volume chamber B reaches the end phase, it is necessary that the N-th volume chamber B reaches the start phase with the next volume chamber B of the specific volume chamber B itself as the first volume chamber B.

Furthermore, in order to make the sum of the discharge amounts of the volume chambers B that perform the discharge work at the same time constant, based on the increase and decrease mode of the instantaneous discharge amount of each of the volume chambers B, when the phase exactly in the middle between the start phase and the central phase is the first intermediate phase, the increasing tendency of the instantaneous discharge amount from the start phase to the first intermediate phase and the increasing tendency from the first intermediate phase to the central phase are inverted to each other with the first intermediate phase interposed therebetween. Furthermore, the increasing tendency from the start phase to the central phase and the decreasing tendency of the instantaneous discharge amount from the central phase to the end phase are symmetric to each other with the central phase interposed therebetween. For example, when imaging a graph in which the rotation phase is on the horizontal axis and the instantaneous discharge amount is on the vertical axis, it is preferable that a continuous discharge curve becomes a sine curve or a triangle wave.

By defining the increase and decrease mode of the instantaneous discharge amount of each of the volume chambers B in this manner, the total instantaneous discharge amount is always constant even in a case where the cam C is at any rotation angle. Accordingly, the pressure fluctuations of the fluid W generated in each of the volume chambers B cancel out each other while increasing the degree of freedom of the number of the volume chambers B to be installed, and it is possible to obtain the fluid pump S having no pulsation as a whole.

The fluid pump according to the disclosure can be widely applied to a pump of a type in which the volume chamber and the moving element are relatively moved by using the cam, such as the radial pump having the plurality of cylinders or the vane pump having a vane-equipped rotor.

A feature of a fluid pump according to an aspect of this disclosure resides in that the fluid pump includes three or more volume chambers that suction and discharge a fluid sequentially; moving elements that are respectively provided in the volume chambers, move relative to the volume chamber, and suction and discharge the fluid from and to the volume chamber; a cam that abuts against and drives the moving element; and a driving section that drives at least one of the moving elements and the cam and relatively rotates the moving elements and the cam to discharge the fluid one time from each of the volume chambers in one cycle of the relative rotation, in which, in each of the volume chambers, when suctioning and discharging the fluid, regarding a discharge rotation angle $\alpha$ from a start phase in which an instantaneous discharge amount of the fluid is zero is achieved, then a central phase in which the instantaneous discharge amount becomes a maximum value is achieved and an end phase in which the instantaneous discharge amount is again zero is achieved among one-cycle rotation angles Z according to the one cycle, $\alpha=(Z/M)\times N$ is satisfied, where the number of volume chambers is M and any integer from 2 to (M−1) is N, in which, when any one of the volume chambers has reached the end phase, an N-th volume chamber subsequent to the volume chamber is configured to be in the start phase, in which, when a phase which is exactly in a middle between the start phase and the central phase is set as a first intermediate phase, an increasing tendency of the instantaneous discharge amount from the start phase to the first intermediate phase and an increasing tendency from the first intermediate phase to the central phase are inverted to each other with the central phase interposed therebetween, and in which an increasing tendency from the start phase to the central phase and a decreasing tendency of the fluid from the central phase to the end phase are symmetric to each other with the first intermediate phase interposed therebetween.

In a case of a type in which the fluid pump relatively moves the volume chamber and the moving element and suctions and discharges the fluid, there are many cases where the flow rate of the fluid that enters the volume chamber usually changes periodically. Therefore, the volume chamber vibrates, the fluid pressure of a fluid piping changes, and the pulsation is generated.

Here, as described in the disclosure, by providing three or more volume chambers and moving elements, fluctuations in fluid pressures generated in each of the volume chambers cancel out each other, and a fluid pump having no pulsation as a whole can be obtained.

In the fluid pump of the configuration, when the angle at which the cam performs one cycle of rotational operation is the one-cycle rotation angle Z, the angle at which the fluid is discharged from the volume chamber among the one-cycle rotation angles Z is the discharge rotation angle $\alpha$, the discharge rotation angle $\alpha=(Z/M)\times N$ can be expressed. Here, M is an integer equal to or greater than 3 expressing the number of volume chambers, and N is any integer from 2 to (M−1).

Z/M is a difference in the rotation angle at which each of the volume chambers performs a discharge operation in one cycle. For example, in a case where the volume chamber=4 and the one-cycle rotation angle Z=360 degrees, the discharge operation of each of the volume chambers is performed every time the cam rotates by 90 degrees.

Meanwhile, N indicates how many volume chambers are in a discharge state at a certain timing. Accordingly, as the N value increases, one volume chamber discharges the fluid over a long rotation angle.

N=1 is not satisfied, and N=M is not satisfied, either. In a case of N=1, one volume chamber always discharges the fluid, the pulsation is constantly generated in the discharge operation of one volume chamber as described above, and thus, even when the discharge of such a volume chamber is continuous, it is not possible to eliminate the pulsation.

Meanwhile, N=M means that the fluid is constantly discharged from all of the volume chambers, and it is not possible to ensure a period for suctioning the fluid for each of the volume chambers.

Furthermore, the N value is an integer. In other words, since a case where one volume chamber is in a discharge state by half is not possible, the fact that the N value becomes a small number, means that, for example, three volume chambers are in the discharge state at a certain moment and two volume chambers are in the discharge state at another moment, the discharge state is not constant, and the pulsation cannot be eliminated. Accordingly, N is an integer between 2 and (M−1).

When any one of the volume chambers has reached the end phase after satisfying the above-described condition, it is necessary that the volume chamber from which the N-th discharge is started following the volume chamber reaches the start phase. For example, in a case of N=2, at a certain moment, a specific volume chamber is in the discharge state together with other volume chambers which started the discharge earlier than the specific volume chamber itself. When it is attempted to make the total discharge amount constant at the time of the discharge start and the discharge end of each of the volume chambers, when the specific volume chamber just starts the discharge, it is necessary that other volume chambers ensure a predetermined discharge amount.

Then, the discharge work of the specific volume chamber is added to the discharge work of the volume chamber which started the discharge one before the specific volume chamber itself in the middle, and after the discharge work of one previous volume chamber is ended, the volume chamber that starts the discharge work one after the specific volume chamber itself is replaced with the volume chamber, and the decrease in the discharge amount of the specific volume chamber itself is compensated by the discharge of the volume chamber one after the specific volume chamber itself. Furthermore, when the discharge of the specific volume chamber itself is ended, the volume chamber is switched to a volume chamber which starts the discharge two volume chambers behind the specific volume chamber itself.

In this manner, in order for N volume chambers to perform the discharge work at all times, when the specific volume chamber reaches the end phase, it is necessary that the N-th volume chamber reaches the start phase with the next volume chamber of the specific volume chamber itself as the first volume chamber.

Furthermore, in order to make the sum of the discharge amounts of the volume chambers that perform the discharge work at the same time constant, based on an increase and decrease mode of the instantaneous discharge amount of each of the volume chambers, when the phase exactly in the middle between the start phase and the central phase is a first intermediate phase, an increasing tendency of the instantaneous discharge amount from the start phase to the first intermediate phase and an increasing tendency from the first intermediate phase to the central phase may be inverted to each other with the first intermediate phase interposed therebetween, and an increasing tendency from the start phase to the central phase and a decreasing tendency of the fluid from the central phase to the end phase may be symmetric to each other with the central phase interposed therebetween. For example, when imaging a graph in which the rotation phase is on the horizontal axis and the instantaneous discharge amount is on the vertical axis, it is preferable that a continuous discharge curve becomes a sine curve or a triangle wave.

With such a configuration, it is possible to obtain a fluid pump having no discharge pulsation as a whole while increasing a degree of freedom of the number of volume chambers installed.

In the fluid pump according to the aspect of this disclosure, it is preferable that the volume chamber is a cylinder having at least one opening related to supply and discharge of the fluid, the moving element is a piston that reciprocates on an inside of the cylinder, at least one of the cam and the cylinder is rotatable so as to repeatedly drive the piston between a bottom dead point and a top dead point, the start phase is a phase in which the cam positions the piston at the bottom dead point, and the end phase is a phase in which the cam positions the piston at the top dead point.

In this manner, by using the cylinder and the piston, it becomes easy to determine a driving mode of the piston by the cam. In addition, since the cylinder has an elongated shape, it is also easy to dispose a plurality of cylinders around the cam, and the degree of freedom in designing the fluid pump increases.

The fluid pump according to the aspect of this disclosure may be configured such that, by providing a discharge amount adjustment surface that mitigates a change in the instantaneous discharge amount from the cylinder by reducing a change in position of the piston with respect to a unit rotation of the cam in a region including a bottom dead corresponding point for positioning the piston at the bottom dead point, and in a region including a top dead corresponding point for positioning the piston at the top dead point, on a cam surface of the cam, the instantaneous discharge amount suddenly increases in a region from the start phase to the first intermediate phase, and the instantaneous discharge amount gradually increases in a region from the first intermediate phase to the central phase, and the instantaneous discharge amount suddenly decreases in a region from the central phase to a second intermediate phase exactly in a middle between the central phase and the end phase, and the instantaneous discharge amount gradually decreases in a region from the second intermediate phase to the end phase.

In this configuration, the discharge amount adjustment surface is provided in the region including the bottom dead corresponding point and the region including the top dead corresponding point of the cam surface, and the change in the instantaneous discharge amount of the fluid near the start phase and near the end phase is mitigated. Accordingly, when one cylinder reaches the end phase, the degree of decrease in the instantaneous discharge amount of the fluid becomes loose. In other words, a state where the discharge of the fluid hardly ends is achieved. Meanwhile, in a case where the subsequent cylinder that replaces the one cylinder becomes the start phase, the degree of increase in the instantaneous discharge amount of the fluid is suppressed. Accordingly, the pressure fluctuation of the fluid when switching the discharge work from a specific cylinder to another cylinder is reduced, and the pulsation is eliminated.

In the fluid pump according to the aspect of this disclosure, the cam may be rotatable around a rotating axis and a cam surface of the cam may be formed on a cylindrical side surface positioned around the rotating axis.

The fluid pump with this configuration is, for example, a radial pump. In a case of the configuration, the piston can be operated for only one cycle by making the cam disposed at the center make one rotation. A predetermined number of cylinders can be installed around the cam in accordance with the size. With the configuration, it is easy to dispose each cylinder, and it is possible to obtain the fluid pump with a stable discharge flow rate only by mainly configuring the cam surface to have a predetermined shape.

In the fluid pump according to the aspect of this disclosure, the cam may be rotatable around a rotating axis and a cam surface of the cam may be formed in an annular shape on a surface facing in an extending direction of the rotating axis.

The fluid pump of the configuration is, for example, an axial pump. In a case of the configuration, since each cylinder can be disposed in parallel, a compact fluid pump can be obtained.

Further, in the axial pump of the configuration, for example, a port portion having a discharge port and a suction port of the fluid is provided on the side opposite to the annular cam surface with respect to the cylinder, and while the cam surface and the port portion are fixed, the four cylinders can be rotated. In this case, the four cylinders rotate, and a communicating portion of the cylinder sequentially communicates with the discharge port and the suction port. Accordingly, it is unnecessary to make flow passages from each of the cylinders protrude and merge the flow passages, and it is possible to obtain a more compact configuration.

The fluid pump according to the aspect of this disclosure may be configured such that the moving element is a rotor that rotates around a rotating axis and a plurality of vanes that are provided in the rotor and are capable of protruding and retracting with respect to the rotor, the volume chamber is a suction chamber and a discharge chamber that are formed by the rotor, the vane and a casing containing the rotor and the vane, and are disposed to be dispersed around the rotating axis, the cam is provided on an inner surface of the casing so as to be in slidable contact with the vane, a discharge port for discharging the fluid is provided in the casing so as to communicate with the discharge chamber, and when, at the discharge port, an upper side of the rotor in a rotational direction is an upper edge portion, a lower side in the rotational direction is a lower edge portion, and two adjacent vanes of the vanes are set as a preceding vane and a following vane, the start phase is a phase when the rotor positions the preceding vane at the upper edge portion, and the end phase is a phase when the rotor positions the following vane at the lower edge portion.

Similar to the configuration, a vane pump can also be configured as a pump in which the pulsation during the fluid discharge is suppressed. One volume chamber in the vane pump is formed by a space between adjacent vanes. The vane is smaller in dimension than the above-described cylinder or piston, and the vane or the rotor can be provided on the inside of one casing. Accordingly, it is possible to make the overall size compact with respect to the discharge ability of the fluid.

In addition, a relatively large number of vanes can be disposed around the rotor, and the degree of freedom of combining the number M of the volume chambers and the number N of the volume chambers which are simultaneously in the discharge state is also high.

Furthermore, in a case of the vane pump, one discharge port is formed so as to face the plurality of volume chambers. Accordingly, the fluid pump of the disclosure can be easily obtained without substantially changing the shape of the vane pump in the related art, such as the need to separately aggregate the discharge passage of the fluid similar to the above-described radial pump.

The fluid pump according to the aspect of this disclosure may be configured such that the fluid pump further includes a discharge amount adjustment surface in which a change in an inner diameter is small along the rotational direction in a region including a first position where the preceding vane is in slidable contact in the start phase, and in a region including a second position where the following vane is in slidable contact in the end phase, on the cam, the instantaneous discharge amount suddenly increases in a region from the start phase to the first intermediate phase, and the instantaneous discharge amount gradually increases in a region from the first intermediate phase to the central phase, and the instantaneous discharge amount suddenly decreases in a region from the central phase to a second intermediate phase exactly in a middle between the central phase and the end phase, and the instantaneous discharge amount gradually decreases in a region from the second intermediate phase to the end phase.

One cause of the generation of the pulsation in the vane pump is that, for example, the fluctuations in discharge flow rates of the discharge chambers on both sides with one vane interposed therebetween are not balanced. When one vane is in the vicinity of the center of the discharge port, there are many cases where the discharge amount from the discharge chamber on the lower side in the rotational direction of the vane is in a decreasing process, and there are many cases where the discharge amount from the discharge chamber on the upper side in the rotational direction is in an increasing process. In other words, when the decrease in the discharge amount of one discharge chamber is balanced with the increase in the discharge amount of the other discharge chamber, the pulsation decreases.

In addition, when the discharge of the fluid from the specific discharge chamber is ended and following this, the fluid starts to be discharged from the other discharge chamber, the pulsation of the fluid is reduced when the decrease and the increase in the instantaneous discharge flow rate smoothly change.

Therefore, in the configuration, by providing the discharge amount adjustment surface for adjusting the discharge amount in the vicinity of the first position and in the vicinity of the second position as the shape of the cam surface, a sudden decrease in the fluid discharge amount is suppressed at the time of the discharge end, a sudden increase in the fluid discharge amount at the time of the discharge start is suppressed, and accordingly, the fluctuation of the discharge pressure at the time of switching the discharge chamber is reduced. Accordingly, the vane pump with small pulsation can be obtained.

In addition, by setting the discharge amount adjustment surface, and by adjusting the change in the instantaneous discharge amount at the time of the discharge end and the discharge start, a change mode of the instantaneous discharge amount from the start phase to the first intermediate phase and a change mode of the instantaneous discharge amount from the first intermediate phase to the central phase are likely to be inverted to each other with the first intermediate phase as the boundary. This is also similar in a case where the instantaneous discharge amount reaches the end phase from the central phase through the second intermediate phase. In addition, the change mode of the instantaneous discharge amount from the start phase to the central phase and the change mode of the instantaneous discharge amount from the central phase to the end phase are likely to be inverted to each other with the central phase as the boundary. As a result, when the instantaneous discharge amounts related to the plurality of discharge chambers are added up, the increment and the decrement complement each other, and the fluid pump with small pulsation as a whole can be obtained.

The fluid pump according to the aspect of this disclosure may be configured such that the fluid pump further includes a second discharge amount adjustment surface in which the change in the inner diameter is small along the rotational direction, in a region with a position exactly in the middle interposed between the first position and the second position, on the cam, and in which the instantaneous discharge amount is maintained at a maximum value while the preceding vane is in slidable contact with the second discharge amount adjustment surface.

Similar to the configuration, by widening the phase in which the instantaneous discharge amount becomes the maximum value, when the rotor rotates, a phase region where the instantaneous discharge amount changes is narrowed and the time period during which the instantaneous discharge amount becomes constant becomes longer. As a result, the pulsation generated from the entire vane pump is further reduced.

The fluid pump according to the aspect of this disclosure may be configured such that, on the cam, an inflection point is provided at a position exactly in the middle between the first position and the second position, and when the preceding vane passes through the inflection point, the instantaneous discharge amount suddenly changes from an increase state to a decrease state.

Similar to the configuration, in a case where the inflection point is provided in the middle of the cam surface, a protruding and retracting operation of the vane with respect to the rotor suddenly changes before and after the inflection point, and thus, there is a case where a certain mechanical vibration is generated. However, it is possible to reduce the change in the instantaneous discharge amount in the region up to the inflection point and in the region after passing through the inflection point as much as the change in the instantaneous discharge amount at the inflection point is large.

As a result, it becomes easy to set the shape of the cam surface, and after making it possible to expect a reduction effect of the generation of the pulsation, such as suppression of the sudden change of the discharge pressure in each of the regions and suppression of the generation of cavitation of the fluid, and it is also possible to simplify the device configuration and to reduce the costs.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A fluid pump comprising:

three or more volume chambers that suction and discharge a fluid sequentially;

moving elements that are respectively provided in the volume chambers, move relative to the volume chamber, and suction and discharge the fluid from and to the volume chamber;

a cam having a cam surface that abuts against and drives the moving elements, said cam surface having at least a predetermined region in a shape other than a perfect circle; and a driving section that drives at least one of the moving elements and the cam and relatively rotates the moving elements and the cam to discharge the fluid one time from each of the volume chambers in one cycle of the relative rotation through rotation angles Z, wherein, in each of the volume chambers, when suctioning and discharging the fluid, regarding a discharge rotation angle $\alpha$ from a start phase in which an instantaneous discharge amount of the fluid is zero is achieved, then a central phase in which the instantaneous discharge amount becomes a maximum value is achieved and an end phase in which the instantaneous discharge amount is again zero is achieved, $\alpha=(Z/M)\times N$ is satisfied, where the number of volume chambers is M and any integer from 2 to (M−1) is N, when any one of the volume chambers has reached the end phase, an N-th volume chamber subsequent to the volume chamber is configured to be in the start phase, a change in rate of increase of the instantaneous discharge amount from the start phase to a first intermediate phase, which is a phase exactly in a middle between the start phase and the central phase, and a change in rate of increase of the instantaneous discharge amount from the first intermediate phase to the central phase, are inverted to each other, and a change in rate of increase of the instantaneous discharge amount from the start phase to the central phase and a change in rate of decrease of the instantaneous discharge amount from the central phase to the end phase are symmetric to each other.

2. The fluid pump according to claim 1, wherein the volume chamber is a cylinder having at least one opening related to supply or discharge of the fluid, the moving element is a piston that reciprocates on an inside of the cylinder, at least one of the cam and the cylinder is rotatable so as to repeatedly drive the piston between a bottom dead point and a top dead point, at the start phase, the cam positions the piston at the bottom dead point, and at the end phase, the cam positions the piston at the top dead point.

3. The fluid pump according to claim 2, wherein by providing a first discharge amount adjustment surface that mitigates a change in the instantaneous discharge amount from the cylinder by reducing a change in position of the piston with respect to a unit rotation of the cam in a region including a bottom dead corresponding point for positioning the piston at the bottom dead point, on the cam surface of the cam, the instantaneous discharge amount increases in a region from the start phase to the first intermediate phase at a rate greater than a rate at which the instantaneous discharge amount increases in a region from the first intermediate phase to the central phase, and wherein by providing a second discharge amount adjustment surface that mitigates a change in the instantaneous discharge amount from the cylinder by reducing a change in position of the piston with respect to a unit rotation of the cam in a region including a top dead corresponding point for positioning the piston at the top dead point, on the cam surface of the cam, the instantaneous discharge amount decreases in a region from the central phase to a second intermediate phase exactly in a middle between the central phase and the end phase at a rate greater than a rate at which the instantaneous discharge amount decreases in a region from the second intermediate phase to the end phase.

4. The fluid pump according to claim 2, wherein the cam is rotatable around a rotating axis and the cam surface of the cam is formed on a cylindrical side surface positioned around the rotating axis.

5. The fluid pump according to claim 2, wherein the cam is rotatable around a rotating axis and the cam surface of the cam is formed in an annular shape on a surface facing in an extending direction of the rotating axis.

6. The fluid pump according to claim 1, wherein the moving element is a rotor that rotates around a rotating axis and a plurality of vanes that are provided in the rotor and are capable of protruding and retracting with respect to the rotor, the volume chamber is a suction chamber and a discharge chamber that are formed by the rotor, the vane and a casing containing the rotor and the vane, and are disposed to be dispersed around the rotating axis, the cam is provided on an inner surface of the casing so as to be in slidable contact with the vane, a discharge port for discharging the fluid is provided in the casing so as to communicate with the discharge chamber, and when, at the discharge port, an upper side of the rotor in a rotational direction is an upper edge portion, a lower side in the rotational direction is a lower edge portion, and two adjacent vanes of the vanes are set as a preceding vane and a following vane, the start phase is a phase when the rotor positions the preceding vane at the upper edge portion, and the end phase is a phase when the rotor positions the following vane at the lower edge portion.

7. The fluid pump according to claim 6, further comprising:

a discharge amount adjustment surface in which a change in an inner diameter is small along the rotational direction in a region including a first position where the preceding vane is in slidable contact in the start phase, and in a region including a second position where the following vane is in slidable contact in the end phase, on the cam, wherein the instantaneous discharge amount suddenly increases in a region from the start phase to the first intermediate phase, and the instantaneous discharge amount gradually increases in a region from the first intermediate phase to the central phase, and the instantaneous discharge amount suddenly decreases in a region from the central phase to a second intermediate phase exactly in a middle between the central phase and the end phase, and the instantaneous discharge amount gradually decreases in a region from the second intermediate phase to the end phase.

8. The fluid pump according to claim 7, further comprising:

a second discharge amount adjustment surface in which the change in the inner diameter is small along the rotational direction, in a region with a position exactly in the middle interposed between the first position and the second position, on the cam, wherein the instantaneous discharge amount is maintained at a maximum value while the preceding vane is in slidable contact with the second discharge amount adjustment surface.

9. The fluid pump according to claim 7, wherein, on the cam, an inflection point is provided at a position exactly in the middle between the first position and the second position, and when the preceding vane passes through the inflection point, the instantaneous discharge amount suddenly changes from an increase state to a decrease state.

10. The fluid pump according to claim 1, wherein the at least one predetermined region bulges relative to the perfect circle.

11. The fluid pump according to claim 1, wherein the at least one predetermined region is recessed relative to the perfect circle.

* * * * *